United States Patent [19]

Takahashi et al.

[11] Patent Number: 4,770,987

[45] Date of Patent: Sep. 13, 1988

[54] SILVER HALIDE COLOR PHOTOGRAPHIC MATERIALS CONTAINING AN ANTISAIN AGENT AND A MAGENTA COUPLER IN LIPOPHILIC FINE PARTICLES

[75] Inventors: Osamu Takahashi; Hideaki Naruse; Masakazu Morigaki; Nobutaka Ohki; Tadahisa Sato, all of Kanagawa, Japan

[73] Assignee: Fuji Photo Film Co., Ltd., Kanagawa, Japan

[21] Appl. No.: 943,035

[22] Filed: Dec. 17, 1986

[30] Foreign Application Priority Data

Dec. 17, 1985 [JP] Japan ..... 60-283831

[51] Int. Cl.[4] ..... G03C 1/06; G03C 7/26

[52] U.S. Cl. ..... 430/546; 430/551; 430/372; 430/607

[58] Field of Search ..... 430/551, 546, 372, 607

[56] References Cited

U.S. PATENT DOCUMENTS

| | | | |
|---|---|---|---|
| 3,615,534 | 10/1971 | Tajima et al. | 430/607 |
| 3,761,262 | 9/1973 | Schranz et al. | 430/372 |
| 4,294,921 | 6/1980 | Yamaguchi et al. | 430/621 |
| 4,352,873 | 10/1982 | Toda et al. | 430/551 |
| 4,358,534 | 11/1982 | Sasaki et al. | 430/372 |
| 4,511,643 | 4/1985 | Toya | 430/551 |
| 4,547,452 | 10/1985 | Toya | 430/372 |
| 4,554,247 | 11/1985 | Yamashita et al. | 430/546 |
| 4,639,413 | 1/1987 | Kawagishi et al. | 430/546 |

*Primary Examiner*—Paul R. Michl
*Assistant Examiner*—Patrick A. Doody
*Attorney, Agent, or Firm*—Birch, Stewart, Kolasch & Birch

[57] ABSTRACT

A silver halide color photographic material is disclosed, comprising a support having provided thereon at least one silver halide emulsion layer having dispersed therein lipophilic fine particles containing an image dye forming lipophilic coupler, wherein the lipophilic fine particles further contain at least one lipophilic compound having a water-solubility of not more than 1% by weight at 25° C. and represented by formula (I):

$$R_0SO_2X \qquad (I)$$

wherein $R_0$ represents a substituted or unsubstituted alkyl, aryl or heterocyclic group having 8 or more total carbon atoms; and X represents a hydrogen atom, an alkali metal atom, an alkaline earth metal atom, a nitrogen-containing organic base, ammonium or a group represented by formula (A):

(A)

wherein $R_1$ represents a hydrogen atom or a substituted or unsubstituted alkyl, aryl or heterocyclic group; $R_2$ represents a hydrogen atom, a halogen atom or a substituted or unsubstituted alkyl, aryl, acyloxy or sulfonyl group; and $R_3$ represents a hydrogen atom or a hydrolyzable group.

The material prevents stain formation on the non-color-developed areas due to aging and the like after processing.

12 Claims, No Drawings

SILVER HALIDE COLOR PHOTOGRAPHIC MATERIALS CONTAINING AN ANTISAIN AGENT AND A MAGENTA COUPLER IN LIPOPHILIC FINE PARTICLES

FIELD OF THE INVENTION

This invention relates to a silver halide color photographic material. More particularly, it relates to a silver halide color photographic material which prevents or retards stain formation in non-color-developed areas (hereinafter referred to as white background) due to aging and the like.

BACKGROUND OF THE INVENTION

In silver halide color photographic materials, a dye image is formed by imagewise exposure and development with an aromatic primary amine developing agent to induce a reaction between an oxidation product of the developing agent and a dye image forming coupler (hereinafter simply referred to as "coupler"). In this image forming system, a combination of yellow couplers, cyan couplers and magenta couplers is generally used.

Various pyrazolone derivatives are hitherto known as magenta couplers. The pyrazolone derivatives usually employed in photographic light-sensitive materials are 4-equivalent couplers. For instance, the formation of 1 mol of a dye upon a coupling reaction with an oxidation product of an aromatic primary amine color developing agent theoretically requires development of 4 mols of silver halide. On the other hand, the development of only 2 mols of silver halide is required when using 2-equivalent pyrazolone derivatives having an active methylene group substituted with a group that is releasable upon oxidative coupling with an oxidation product of an aromatic primary amine developing agent. In addition, the 4-equivalent pyrazolone derivatives show a low efficiency in color formation (i.e., conversion of coupler to dye and usually produce only about ½ mol of a dye per mol of the coupler.

Hence, it has been heretofore proposed to reduce the amount of silver halide required for development and improve the color formation efficiency by using 2-equivalent pyrazolone magenta couplers. For example, pyrazolone derivatives that release an oxygen atom include 5-pyrazolone having an aryloxy group at the 4-position as described in U.S. Pat. No. 3,419,391 and 5-pyrazolone having an alkoxy group at the 4-position as described in Japanese Patent Publication No. 46453/78.

Examples of pyrazolone derivatives which release a nitrogen atom include compounds having an imidazolyl group, a pyrazolyl group, a triazolyl group, etc. at the 4-position as described in U.S. Pat. Nos. 4,076,533 and 4,241,168; compounds having a pyridonyl group, a 2-oxopiperidinyl group, etc. at the 4-position as described in U.S. Pat. No. 4,220,470; and compounds having a sulfonamido group, etc. at the 4-position as described in U.S. Pat. No. 4,237,217.

Examples of pyrazolone derivatives that release a sulur atom include compounds having a heterocyclic thio group or an arylthio group at the 4-position as described in U.S. Pat. Nos. 3,227,554 and 4,263,723 and Japanese Patent Publication No. 34044/78; compounds having a thiocyano group at the 4-position as described in U.S. Pat. No. 3,214,437; and compounds having a dithiocarbamate group at the 4-position as described in U.S. Pat. No. 4,032,346.

Many of these 2-equivalent couplers can be synthesized from 4-equivalent pyrazolones through a single step. They are also advantageous in terms of sensitivity and equivalency. Inter alia, 5-pyrazolones having a 2-alkoxyarylthio group at the 4-position have specifically proven to be excellent in performance among the sulfur-releasing couplers. The couplers having a 2-alkoxyarylthio group produce a magenta image which is fast to light, while couplers having other arylthio groups produce a magenta image having seriously reduce light fastness.

On the other hand, it is necessary to improve the color reproducibility of the 5-pyrazolone in view of the side absorption observed in the vicinity of 430 nm, a dull cut in the longer wavelength region, and the like. Pyrazoloazole couplers are known magenta couplers which eliminate these disadvantages and are disclosed in Japanese Patent Application (OPI) Nos. 171956/84, 33552/85 and 43659/85.

Color photographic images obtained by using these couplers are usually preserved as photographic records in albums, etc. for a long time or put on exhibition. However, the white background of the image dye is not always resistant to light, heat or humidity and often suffers color change (hereinafter referred to as stain or stain formation) which deteriorates the image qualities when a photographic print or negative, etc. is exposed to light or preserved in high temperature or high humidity conditions over an extended period of time or stored in albums, etc. for many years.

The cause of stain is not clear but many possibilities are considered. For example, the following two assumptions seem probable: (1) Couplers themselves decompose to cause yellowing of the white background; (2) A developing agent remaining in the emulsion layers after the development process is gradually oxidized with oxygen in air, etc. and the resulting oxidation product reacts with couplers (e.g., magenta couplers) to form stain (e.g., magenta stain). Since a magenta color has a high visibility to human eyes, magenta stain particularly brings about a serious reduction in the image quality.

Making the problem more difficult is the fact that it is rare that a new development processing solution is prepared for every development process. In fact, development processing is carried on while the processing solutions are replenished according to the load which is to be processed. The compositions of the processing solutions cannot be simply maintained by making up for the loss due to processing. More specifically, since the development processing solutions generally consist of a color developer, a stopping solution, a bleaching solution, a fixing solution or a blix solution, and the like which are kept at a high temperature of from 31° to 43° C. during processing, the compositions of these processing solutions undergo changes arising from, for example, decomposition or air-oxidation of a developing agent, etc. over a long period of time, accumulation of impurities dissolved out from the photographic materials, carry-over of a processing solution which is adhered to the photographic materials into a next bath, and the like. Restoration of these running solutions is by the replenishment of the shortage of chemicals or by the removal of unnecessary components, but complete restoration cannot be achieved.

When development processing is conducted in such a running solution, components of a developer remain in the photographic light-sensitive materials, thus readily causing stain formation. None of the conventional techniques has succeeded in the effective prevention of stain formation. For instance, it has been proposed to prevent stains by using alkylhydroquinones (e.g., those described in U.S. Pat. Nos. 3,935,016 and 3,960,570, etc.), chromans or coumarans (e.g., those described in U.S. Pat. No. 2,360,290), phenolic compounds (e.g., those described in Japanese Patent Application (OPI) No. 9449/76), sulfinic acid type polymers (e.g., those described in Japanese Patent Application (OPI) No. 151937/81), and the like. Although these compounds are noted to produce more or less of an effect on stains generated during processing, they are virtually ineffective on the prevention of stain formation due to exposure to humidity or heat after color development processing. Japanese Patent Application (OPI) No. 67842/81 discloses that a compound obtained by reacting a nitrogen-containing organic base or a quaternary nitrogen-containing compound with sulfinic acid is incorporated in light-sensitive materials. However, objects of this proposal are essentially different from those of the present invention hereinafter described. That is, one of the objects of the former proposals is to provide a silver halide photographic material which is stable and amendable to rapid processing by incorporating an aromatic primary amine developing agent in the form of a precursor thereof, and another object is to stabilize photographic properties of light-sensitive materials before development processing.

SUMMARY OF THE INVENTION

One of the objects of this invention is to provide a silver halide color photographic material which prevents or retards stain formation on the white background after color development processing even when the material is preserved or exhibited for an extended period of time.

The above object of the present invention is effectively accomplished by a silver halide color photographic material comprising a support having provided thereon at least one silver halide emulsion layer having dispersed therein lipophilic fine particles containing an image dye forming lipophilic coupler, wherein said lipophilic fine particles further contain at least one lipophilic compound represented by formula (I) and having a water-solubility of not more than 1% by weight at 25° C.

Formula (I) is represented by:

$$R_O SO_2X \qquad (I)$$

wherein $R_O$ represents a substituted or unsubstituted alkyl, aryl or heterocyclic group having 8 or more total carbon atoms; and X represents a hydrogen atom, an alkali metal atom, an alkaline earth metal atom, a nitrogen-containing organic base, ammonium, or a group represented by formula (A):

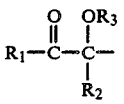

(A)

wherein $R_1$ represents a hydrogen atom or a substituted or unsubstituted alkyl, aryl or heterocyclic group; $R_2$ represents a hydrogen atom, a halogen atom or a substituted or unsubstituted alkyl, aryl, acyloxy or sulfonyl group; and $R_3$ represents a hydrogen atom or a hydrolyzable group.

DETAILED DESCRIPTION OF THE INVENTION

In the formula (I), two or more $—SO_2X$ groups, which may be the same or different, may be bonded to $R_O$. $R_O$ is a bulky group but preferably does not comprise a polymeric chain. The molecular weight of the compound represented by formula (I) is preferably less than 1,000.

The alkyl group as represented by $R_O$ may have a straight chain, branched, or cyclic structure, and includes ethyl, butyl, hexyl, octyl, decyl, dodecyl, hexadecyl, octadecyl, etc. Of these, the alkyl groups having not more than 7 carbon atoms are substituted so as to have 8 or more carbon atoms in total in order to enhance lipophilic properties. The term "alkyl group" as used herein embraces alkenyl groups.

The alkyl group having 8 or more carbon atoms may also have a substituent. Examples of the substituents include a substituted or unsubstituted phenyl group, a nitro group, an amino group, a hydroxyl group, a cyano group, a sulfo group, an alkoxy group (e.g., methoxy, ethoxy, etc.), an aryloxy group (e.g., phenoxy, etc.), an acyloxy group (e.g., acetoxy, etc.), an acylamino group (e.g., acetylamino, etc.), a sulfonamido group (e.g., methanesulfonamido, etc.), a sulfamoyl group (e.g., methylsulfamoyl, etc.), a halogen atom (e.g., fluorine, chlorine, bromine and iodine), a carboxyl group, a carbamoyl group (e.g., methylcarbamoyl, etc.), an alkoxycarbonyl group (e.g., methoxycarbonyl, etc.), and a sulfonyl group (e.g., methylsulfonyl, etc.). When the alkyl group has two or more substituents, these substituents may be the same or different.

When the alkyl group is substituted with a substituted phenyl group, the substituents for the phenyl group include an alky group (e.g., methyl, ethyl, pentyl, etc.), an aryl group, and all the substituents enumerated for the alkyl group.

When $R_O$ represents an aryl or heterocyclic group, compounds represented by formula (I)-B are particularly preferred:

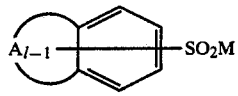

(I)-B wherein A represents an atomic group forming an aromatic ring (inclusive of a heterocyclic ring) condensed to the benzene ring, wherein said aromatic ring or benzene ring is substituted or unsubstituted; M represents a hydrogen atom, an ammonium ion, an alkali metal ion, or an alkaline earth metal ion; l represents 1 or 2; and $SO_2M$ is single or plural.

In formula (I)-B, the benzene-condensed aromatic ring formed by A includes a naphthalene ring, a quinoline ring, an indole ring, a benzothiophene ring, etc.

The benzene or aromatic ring may be substituted with one or more of a halogen atom, a nitro group, an amino group, a hydroxyl group, an alkyl group (inclusive of a cycloalkyl group), an aryl group, an acyl group, an acyloxy group, an acylamino group, a carbamoyl group, a sulfamoyl group, an alkoxy group, an aryloxy group, etc., with specific examples thereof having been recited above.

The alkali metal atom and alkaline earth metal atom as represented by X include Na, K, Li, etc., and Ca, Ba, etc., respectively. The nitrogen-containing organic base includes general amines capable of forming salts with sulfinic acid but does not include color developing agents because an unnecessary reaction with a dye forming coupler present in the lipophilic fine particles is apt to take place to deteriorate image quality. The ammonium represented by X includes not only $NH_4$ but a quaternarized nitrogen-containing organic base as described above. X preferably represents an alkali metal atom, an alkaline earth metal or the group represented by formula (A).

In formula (A), $R_1$ represents a hydrogen atom, a substituted or unsubstituted alkyl group (preferably a straight, branched or cyclic alkyl group having from 1 to 20 carbon atoms, e.g., methyl, ethyl, t-butyl, t-amyl, cyclohexyl, etc.), a substituted or unsubstituted aryl group (preferably an aryl group having from 6 to 30 carbon atoms, e.g., phenyl, naphthyl, etc.), or a substituted or unsubstituted heterocyclic group (preferably a 5- to 7-membered heterocyclic ring, which may be condensed with, for example, an aromatic ring, e.g., a benzene ring, a naphthalene ring, etc., to form a bicyclic or tricyclic ring, with specific examples of such a heterocyclic ring including pyridyl, pyrimidyl, indolyl, isoquinolyl, etc.).

The substituents for the substituted alkyl, aryl or heterocyclic group for $R_1$ include a halogen atom, a nitro group, an amino group, a hydroxyl group, a carboxyl group, an alkyl group, a cycloalkyl group, an aryl group, an allyl group, an acyl group, an acylamino group, a carbamoyl group, a sulfamoyl group, an alkoxy group, etc. The substituted alkyl, aryl or heterocyclic group may have two or more of these groups.

$R_2$ represents a hydrogen atom, a halogen atom (particularly, chlorine or bromine), a substituted or unsubstituted alkyl group (preferably a straight, or branched chain alkyl group having from 1 to 20 carbon atoms, e.g., methyl, ethyl, propyl, isopropyl, etc.), a substituted or unsubstituted aryl group (preferably an aryl group having from 6 to 30 carbon atoms, e.g., phenyl, naphthyl, etc.), an acyloxy group (preferably an acyloxy group having a substituted or unsubstituted alkyl or aryl group having up to 30 carbon atoms, e.g., acetoxy, etc.), or a sulfonyl group (preferably a sulfonyl group having a substituted or unsubstituted alkyl or aryl group having up to 30 carbon atoms, e.g., benzenesulfonyl, tosyl, etc.).

The same substituents as enumerated for the substituted alkyl or aryl group as $R_1$ can also be applied to the substituted alkyl or aryl group for $R_2$.

$R_3$ represents a hydrogen atom or a hydrolyzable group. The hydrolyzable group can be represented by, for example, the formula $$-\overset{\overset{\displaystyle O}{\|}}{C}R_4,$$

wherein $R_4$ represents a hydrogen atom, a substituted or unsubstituted straight or branched chain alkyl group having from 1 to 20 carbon atoms (e.g., methyl, ethyl, t-butyl, pentadecyl group, etc.), a substituted or unsubstituted aryl group having from 6 to 30 carbon atoms (e.g., phenyl, naphthyl, etc.), an acyl group having from 2 to 20 carbon atoms (e.g., benzoyl, stearoyl, etc.), or an alkoxy group having from 1 to 20 carbon atoms (e.g., methoxy, ethoxy, etc.).

The substituents for the substituted alkyl or aryl group include one or more selected from a halogen atom, a nitro group, an amino group, a hydroxyl group, an alkyl group, a cycloalkyl group, an aryl group, an allyl group, an acyl group, an acylamino group, a carbamoyl group, a sulfamoyl group, an alkoxy group, etc.

The compounds represented by formula (I) wherein X is the group represented by formula (A) are considered to act as a precursor of sulfinic acid.

The compounds of formula (I) according to the present invention are lipophilic (i.e., hydrophobic) and should exhibit water-solubility of not more than 1% by weight, preferably not more than 0.5% by weight, and more preferably not more than 0.2% by weight, at 25° C.

As a result of studies, it has been confirmed that stains can first be effectively prevented by incorporating the compounds of formula (I) having the limited water-solubility in the lipophilic fine powders containing couplers. The reasons accounting for stain are not clear, but the effect seems attributable to the fact that the cause of stain formation partly consists of the developing agents remaining in the light-sensitive materials, particularly lipophilic fine particles in which couplers are present. Also, stain may be partly attributable to the couplers themselves. In other words, it is believed that the causes of stain formation can first be effectively removed by the presence of the compound of formula (I) in the lipophilic fine particles which are filled with the causes of stain formation, such as remaining developing agent. Therefore, if the compounds of formula (I) are distributed into an aqueous phase, i.e., a gelatin aqueous solution phase, in a considerable proportion, the effect of stain prevention is seriously reduced. When the compounds have higher water solubility, they are eluted from the light-sensitive materials during development processing, obviously failing to contribute to stain prevention after processing. Further, there is a danger that adsorption onto silver halides, and the like may cause desensitization or deterioration of stability with time in photographic properties of the light-sensitive materials before processing.

On this account, it would be understood that the compounds of formula (I) should be lipophilic, and the smaller the solubility in water, the better. Accordingly, the alkyl group as represented by $R_0$ should have 8 or more carbon atoms, and preferably 12 or more, in total including the substituents thereof. When $R_0$ is an aryl group, the total number of carbon atoms including the carbon atoms of the substituents therefor is also preferably 8 or more.

Specific but non-limiting examples of the compounds represented by formula (I) are shown below:

I-1

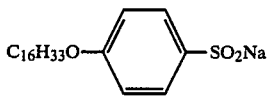

I-2

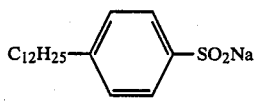

-continued
I-3
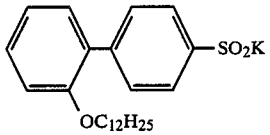
I-4
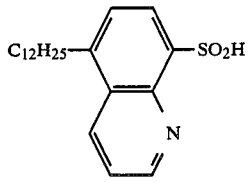
I-5
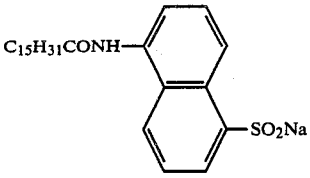
I-6
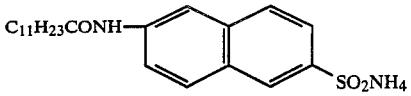
I-7
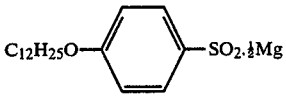
I-8
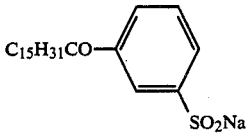
I-9
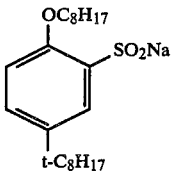
I-10
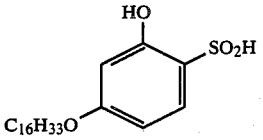
I-11
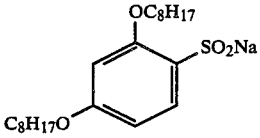
I-12
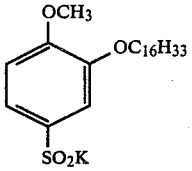
I-13
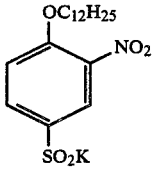
I-14
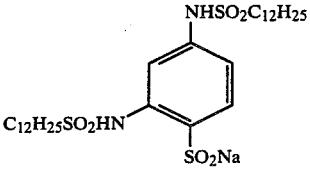
I-15
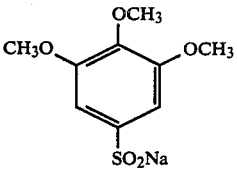
I-16
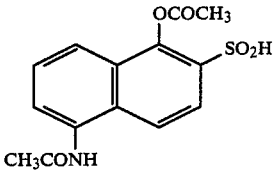
I-17
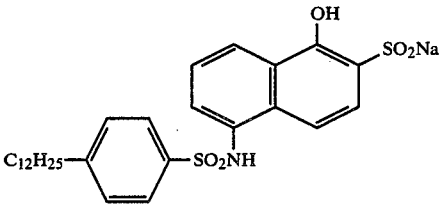
I-18
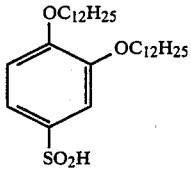
I-19
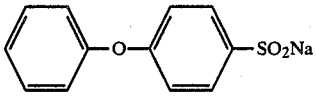
I-20
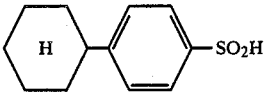

-continued
I-21
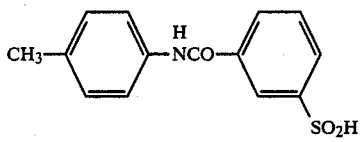
I-22
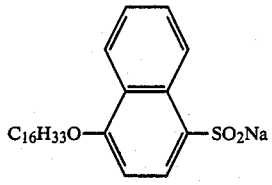
I-23
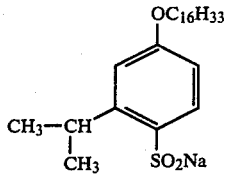
I-24
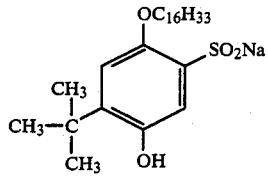
I-25
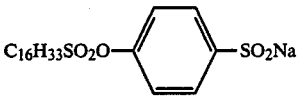
I-26
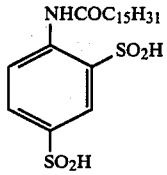
I-27
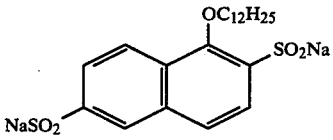
I-28
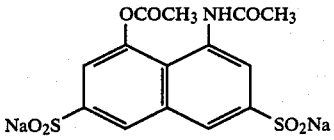
I-29
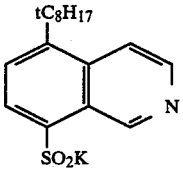
I-30
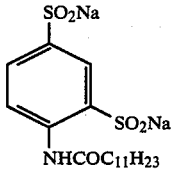
I-31
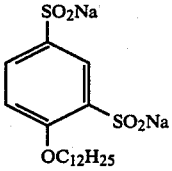
I-32
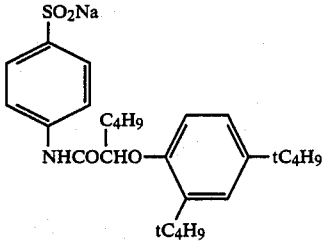
I-33
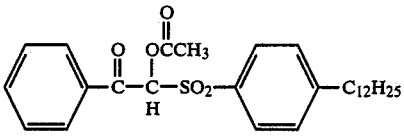
I-34
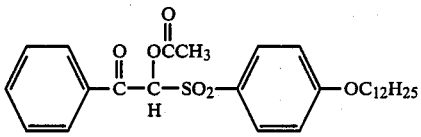
I-35
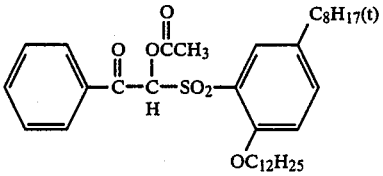
I-36
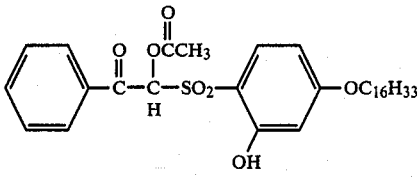

-continued
I-37
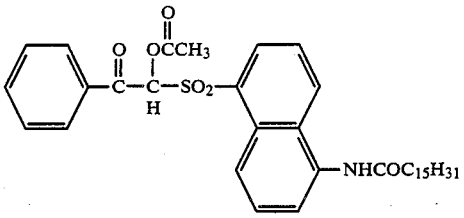
I-38
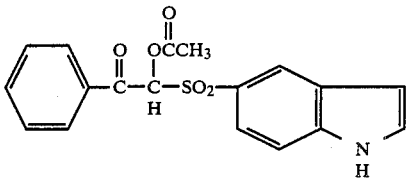
I-39
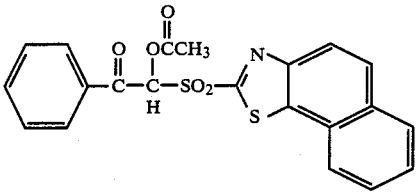
I-40
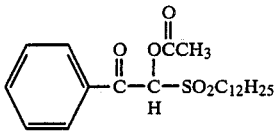
I-41
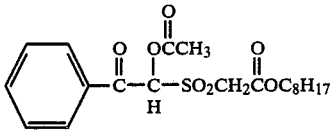
I-42
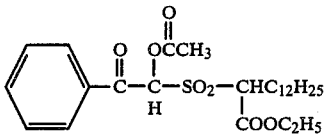
I-43
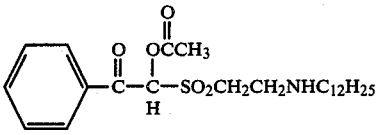
I-44
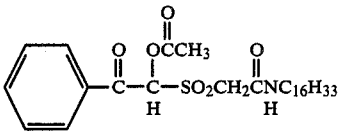
I-45
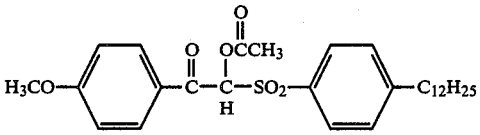
I-46
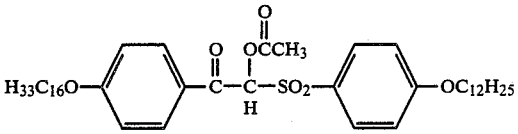
I-47
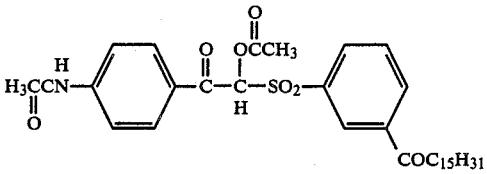
I-48
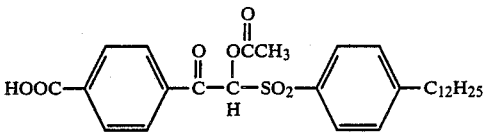
I-49
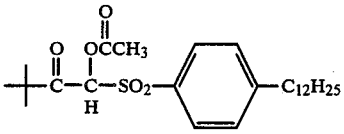
I-50
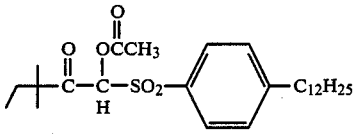
I-51
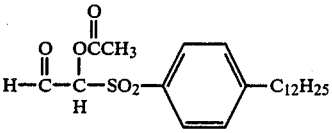
I-52
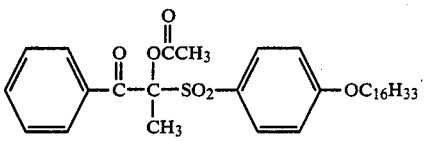
I-53
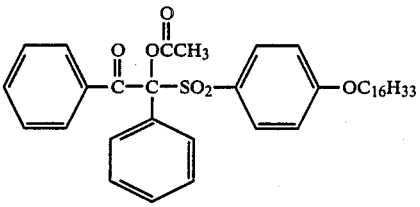
I-54
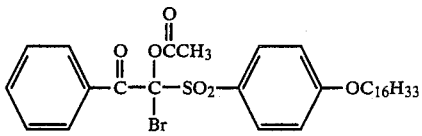

-continued
I-55
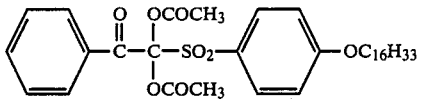
I-56
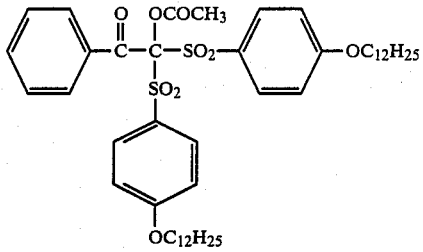
I-57
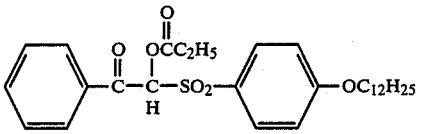
I-58
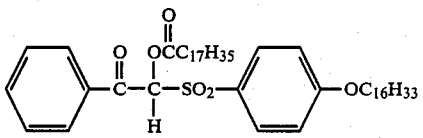
I-59
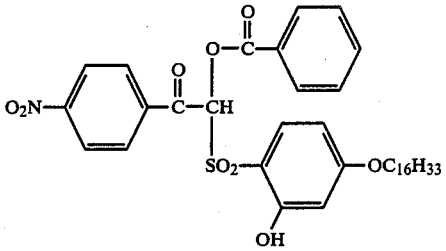
I-60
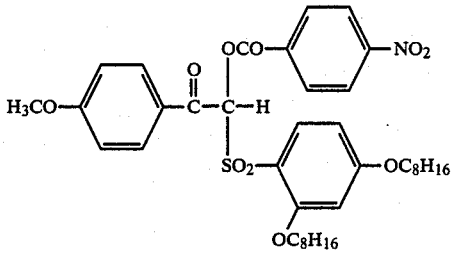
I-61
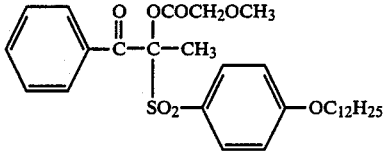
I-62
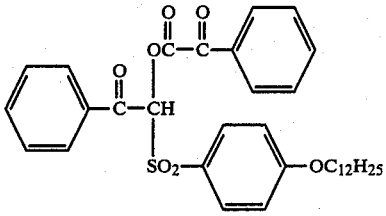
I-63
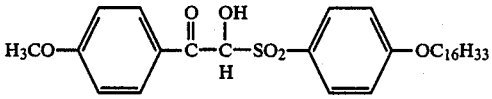
I-64
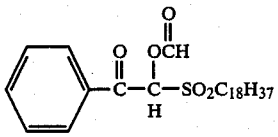
I-65
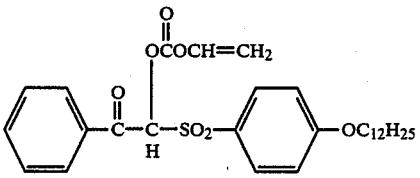
I-66
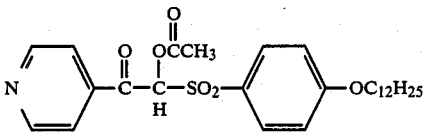
I-67
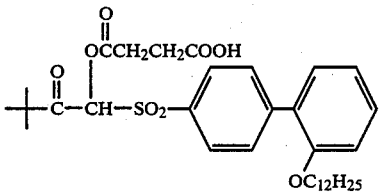
I-68
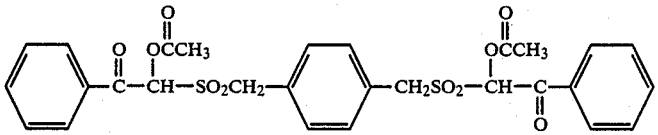

-continued

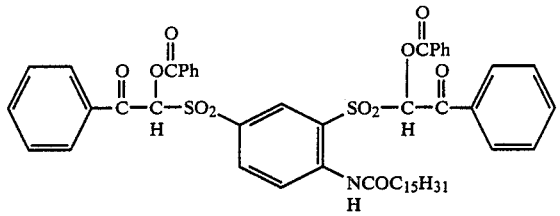

I-69

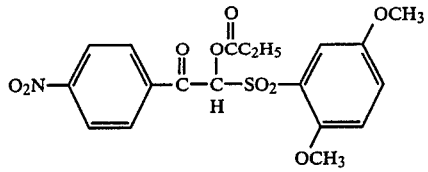

I-70

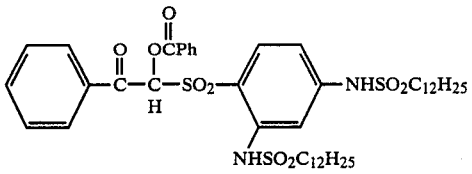

I-71

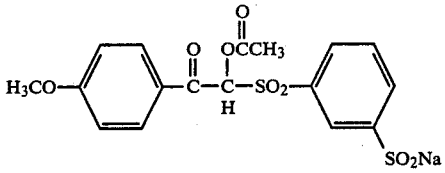

I-72

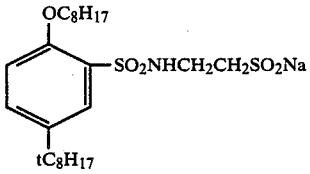

I-73

A process for synthesizing the compounds of formula (I) will be illustrated below taking Compound (I-34) as a specific example.

SYNTHESIS EXAMPLE

Process A

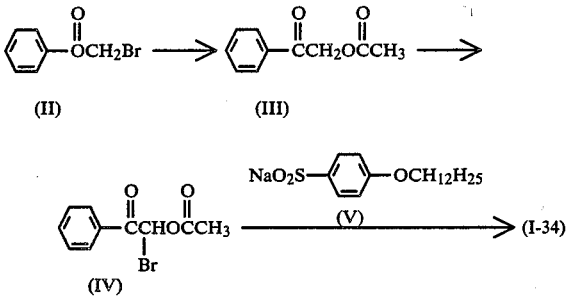

(a) Synthesis of Compound (III):

50 g of phenacyl bromide (II) was dissolved in 300 ml of a mixed solvent of dimethyl formamide and acetic acid (9:1 by volume), 103 g of sodium acetate was added thereto, followed by stirring at 40° C. for 2 hours. The reaction mixture was slowly poured into 2 liters of ice-water and the colorless crystals thus precipitated were filtered to yield 38 g (85%) of Compound (III).

(b) Synthesis of Compound (IV):

35 g of Compound (III) was dissolved in 250 ml of acetic acid, and 33 g of bromine was slowly added dropwise thereto while stirring at 50° C. After the addition of bromine, the stirring was continued for an additional one hour. The reaction mixture was then poured into ice-water. The mixture was extracted with chloroform, and the extract was washed with water, dried over sodium sulfate and concentrated to obtain 41 g (81%) of Compound (IV) as an oily product.

(c) Synthesis of Compound (I-34):

Twenty grams of Compound (IV) were dissolved in 200 ml of tetrahydrofuran, and a solution of Compound (V)* in water-tetrahydrofuran was added thereto while stirring at room temperature. After stirring for one hour, the reaction mixture was poured into ice-water, and the crystals formed were separated by filtration. The resulting crystals were dissolved in ethyl acetate and any insoluble matter was removed by filtration. The ethyl acetate was removed from the filtrate by distillation under reduced pressure. Recrystallization of the residue from methanol gave 17.5 g (45%) of Compound (I-34) having a melting point of 79° to 81° C.

*The sulfinic acid compounds represented by formula (V) as used above can be synthesized according to known processes as described, for instance, in S. R. Sandler and W. Karo, *Organic Functional Group Preparation*, 519, Academic Press (1968).

Process B

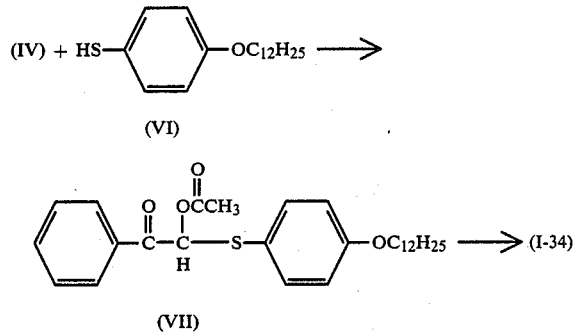

(a) Synthesis of Compound (VII):

25 g of Compound (VI) was dissolved in 200 ml of dichloromethane and 19.7 ml of a 28 wt% methanol solution of sodium methoxide was added thereto, followed by stirring at room temperature for 30 minutes. 100 ml of a dichloromethane solution containing 25 g of Compound (IV) was slowly added to the resulting solution, followed by stirring at room temperature for 30 minutes. The reaction mixture was washed with water, dried over sodium sulfate and concentrated. The residue was subjected to column chromatography using a mixed solvent of hexane-ethyl acetate (5:1 by volume) as an eluent. From the eluate, there was obtained 25.5 g (55%) of Compound (VII).

(b) Synthesis of Compound (I-34):

Twenty grams of Compound (VII) were dissolved in 300 ml of acetic acid and 70 ml of a 35 wt% aqueous solution of hydrogen peroxide was added to the solution. A spoonful of sodium tungstate was further added thereto and the mixture was stirred at 80° C. for 1 hour. The reaction mixture was poured into ice-water and extracted with ethyl acetate. The extract was washed with water, dried over sodium sulfate and concentrated. Recrystallization of the residue from methanol yielded 18 g (84%) of Compound (I-34).

The term "lipophilic fine particles" as used herein means fine particles that form independent phases in a gelatin aqueous solution without being dissolved in the gelatin aqueous solution. The term "contain" as in the phrase "the lipophilic fine particle contain lipophilic couplers or lipophilic compounds represented by formula (I)" indicates not only the state where these compounds are dissolved in the lipophilic fine particles but also the state where these compounds are impregnated in the fine particles.

The substances constituting the lipophilic fine particles include not only oily solvents (inclusive of those solid at room temperature, e.g., waxes) for additives, such as couplers, but also additives serving per se as oily solvents, such as latex polymers, couplers, color mixing preventing agents, ultraviolet absorbents, and the like.

The lipophilic fine particles according to the present invention can generally be prepared by dissolving couplers and the compounds of formula (I) in a high-boiling solvent having a boiling point of 170° C. or higher (hereinafter referred to as oil), a low-boiling solvent (when oils are not required as described above), or a mixed solvent of said oil and said low-boiling solvent, and emulsifying and dispersing the resulting solution in a hydrophilic colloid aqueous solution, such as a gelatin solution. The particle size of the lipophilic fine particles is not particularly restricted, but is preferably from 0.05 to 0.5 μm, and more preferably from 0.1 to 0.3 μm. The oil/coupler ratio in the lipophilic fine particles preferably ranges from 0.00 (i.e., oil is not present) to 2.0 by weight.

The compounds of formula (I) are present in the coupler-containing lipophilic fine particles in an amount of from $1\times10^{-2}$ to 10 mols, and preferably from $3\times10^{-2}$ to 5 mols, per mol of coupler.

Specific examples of the oils which can be used as a solvent include alkyl phthalates (e.g., dibutyl phthalate, dioctyl phthalate, diisodecyl phthalate, dimethoxyethyl phthalate, etc.), phosphoric esters (e.g., diphenyl phosphate, triphenyl phosphate, tricresyl phosphate, dioctylbutyl phosphate, monophenyl-p-t-butylphenyl phosphate, etc.), citric esters (e.g., tributyl acetylcitrate, etc.), benzoic esters (e.g., octyl benzoate, etc.), alkylamides (e.g., diethyllaurylamide, dibutyllaurylamide, etc.), fatty acid esters (e.g., dibutoxyethyl succinate, diethyl azelate, etc.), trimesic esters (e.g., tributyl trimesate, etc.), compounds containing an epoxy ring (e.g., compounds disclosed in U.S. Pat. No. 4,540,657), phenols (e.g.,

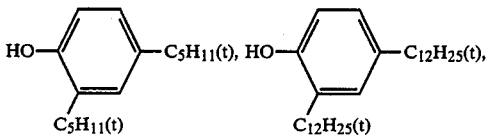

-continued

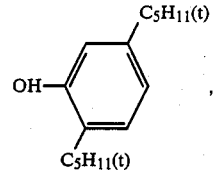

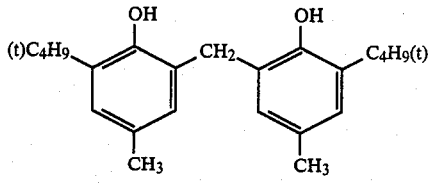

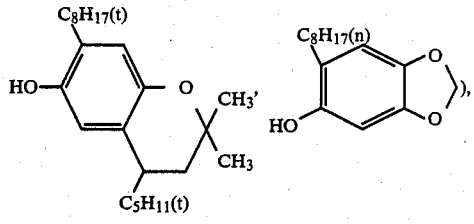

and ethers (e.g., phenoxyethanol, diethylene glycol monophenyl ether, etc.).

The latex polymers which can be used in the present invention include those prepared from one or more monomers, such as acrylic acid or methacrylic acid and esters thereof (e.g., methyl acrylate, ethyl acrylate, butyl methacrylate, etc.), acrylamide, methacrylamide, vinyl esters (e.g., vinyl acetate, vinyl propionate, etc.), acrylonitrile, styrene, divinylbenzene, vinyl alkyl ethers (e.g., vinyl ethyl ether, etc.), maleic esters (e.g., methyl maleate, etc.), N-vinyl-2-pyrrolidone, N-vinylpyridine, 2- or 4-vinylpyridine, etc.

The low-boiling solvents which can also be used in the preparation of the lipophilic fine powders are organic solvents having a boiling point of from about 30° to about 150° C. at atmospheric pressure, such as lower alkyl acetates (e.g., ethyl acetate, isopropyl acetate, butyl acetate, etc.), ethyl propionate, methanol, ethanol, sec-butyl alcohol, cyclohexanol, fluorinated alcohols, ethyl isobutyl ketone, β-ethoxyethyl acetate, methyl cellosolve acetate, acetone, methyl acetone, acetonitrile, dioxane, dimethylformamide, dimethyl sulfoxide, chloroform, cyclohexane, and so on.

The silver halide color photographic materials according to the present invention comprise a support having provided thereon at least one silver halide emulsion layer having dispersed therein lipophilic fine particles containing the compounds represented by formula (I) and image dye forming lipophilic couplers wherein said lipophilic fine particles contain substantially no color developing agents or precursors thereof. Color development processing of the photographic materials of this invention with a color developer containing a color developing agent produces color prints whose white background does not undergo color change even when preserved or exhibited for a long period of time.

Couplers which can be used in the present invention include magenta couplers, cyan couplers and yellow couplers. Inter alia, combinations of the compounds of formula (I) with magenta couplers are preferred.

The magenta couplers to be used preferably include 5-pyrazolone couplers, and the preferred among them are 2-equivalent couplers.

The 5-pyrazolone couplers are typically exemplified by those substituted with an arylamino or acylamino group at their 3-position. Specific examples of such couplers are described, for example in U.S. Pat. Nos. 2,311,082, 2,343,703, 2,600,788, 2,908,573, 3,062,653, 3,152,896 and 3,936,015. Preferred releasable groups for the 2-equivalent 5-pyrazolone couplers are nitrogen-releasing groups as disclosed in U.S. Pat. No. 4,310,619 and arylthio groups as disclosed in U.S. Pat. No. 4,351,897. 5-Pyrazolone couplers with ballast groups as disclosed in European Pat. No. 73,636 provide high color densities.

The most preferred couplers to be combined with the compounds of formula (I) are pyrazoloazole magenta couplers represented by formula (VIII), and particularly the 2-equivalent couplers thereof.

Formula (VIII) is represented by:

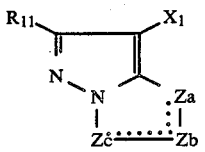

wherein $R_{11}$ represents a hydrogen atom or a substituent; $X_1$ represents a hydrogen atom or a group releasable upon coupling with an oxidation product of an aromatic primary amine developing agent; Za, Zb and Zc each represents a methine group, a substituted methine group, =N— or —NH—, wherein either one of Za-Zb bond and Zb-Zc bond is a double bond, with the other being a single bond. The Zb-Zc bond when representing a carbon-carbon double bond may form a part of an aromatic ring. $R_{11}$, $X_1$ or the substituted methine group as represented by Za, Zb or Zc may form a polymer including a dimer.

In the definition of formula (VIII), the term "polymer" means a compound composed of at least two groups derived from formula (VIII) per molecule and includes bis-compounds and polymer couplers. The polymer couplers herein referred to include not only homopolymers solely comprising a monomer having the moiety represented by formula (VIII) (preferably a monomer having a vinyl group, hereinafter referred to as a "vinyl monomer") but copolymers with noncolor-forming ethylenic monomers which do not undergo coupling with an oxidation product of an aromatic primary amine developing agent.

Among the pyrazoloazole magenta couplers represented by formula (VIII), the preferred are those represented by formulae (IX) to (XV):

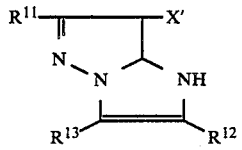

(IX)

-continued

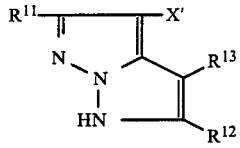

(X)

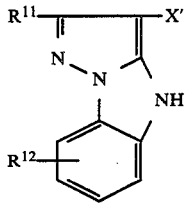

(XI)

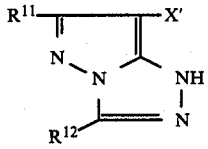

(XII)

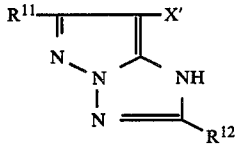

(XIII)

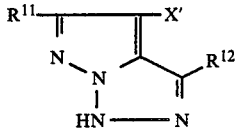

(XIV)

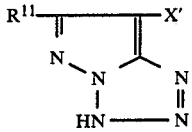

(XV)

The preferred couplers represented by formulae (IX) to (XV) are those of formulae (IX), (XII) and (XIII), with those of formulae (XII) and (XIII) being more preferred.

In formulae (IX) to (XV), $R^{11}$, $R^{12}$ and $R^{13}$ (which may be the same or different) each represents a hydrogen atom, a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group, or an aryloxycarbonyl group; X' represents a hydrogen atom, a halogen atom, a carboxyl group, an arylazo group, or a coupling releasable group which is bonded to the carbon atom at the coupling site via an oxygen atom, a nitrogen atom, or a sulfur atom; $R^{11}$, $R^{12}$ or X' may be divalent group to form a bis compound.

These couplers may have a polymer form, in which the coupler residue represented by formulae (IX) to (XV) is present in the main or side chain. In particular, polymers derived from vinyl monomers having the moiety represented by formulae (III), (VI) and (VII) are preferred. In this case, $R^{11}$, $R^{12}$, $R^{13}$ or X' represents a vinyl group or a linking group.

More specifically, $R^{11}$, $R^{12}$ and $R^{13}$ each represents a hydrogen atom, a halogen atom (e.g., a chlorine atom, a bromine atom, etc.), an alkyl group (e.g., a methyl group, a propyl group, an isopropyl group, a t-butyl group, a trifluoromethyl group, a tridecyl group, a 2-[α-{3-(2-octyloxy-5-t-octylbenzenesulfonamido)phenoxy}tetradecaneamido]ethyl group, a 3-(2,4-di-t-amylphenoxy)propyl group, an allyl group, a 2-dodecyloxyethyl group, a 1-(2-octyloxy-5-t-octylbenzenesulfonamido)-2-propyl group, a 1-ethyl-1-{4-(2-butoxy-5-t-octylbenzenesulfonamido)phenyl}methyl group, a 3-phenoxypropyl group, a 2-hexylsulfonyl-ethyl group, a cyclopentyl group, a benzyl group, etc.), an aryl group (e.g., a phenyl group, a 4-t-butylphenyl group, a 2,4-di-t-amylphenyl group, a 4-tetradecaneamidophenyl group, etc.), a heterocyclic group (e.g., a 2-furyl group, a 2-thienyl group, a 2-pyrimidinyl group, a 2-benzothiazolyl group, etc.), a cyano group, an alkoxy group (e.g., a methoxy group, an ethoxy group, a 2-methoxyethoxy group, a 2-dodecyloxyethoxy group, a 2-methanesulfonylethoxy group, etc.), an aryloxy group (e.g., a phenoxy group, a 2-methylphenoxy group, a 4-t-butylphenoxy group, etc.), a heterocyclic oxy group (e.g., a 2-benzimidazolyloxy group, etc.), an acyloxy group (e.g., an acetoxy group, a hexadecanoyloxy group, etc.), a carbamoyloxy group (e.g., an N-phenylcarbamoyloxy group, an N-ethylcarbamoyloxy group, etc.), a silyloxy group (e.g., a trimethylsilyloxy group, etc.), a sulfonyloxy group (e.g., a dodecylsulfonyloxy group, etc.), an acylamino group (e.g., an acetamido group, a benzamido group, a tetradecaneamido group, an α-(2,4-di-t-amylphenoxy)butylamido group, a γ-(3-t-butyl-4-hydroxyphenoxy)butylamido group, an α-{4-(4-hydroxyphenylsulfonyl)phenoxy}decaneamido group, an anilino group (e.g., a phenylamino group, a 2-chloroanilino group, a 2-chloro-5-tetradecaneamidoanilino group, a 2-chloro-5-dedecyloxycarbonylanilino group, an N-acetylanilino group, a 2-chloro-5-{α-(3-t-butyl-4-hydroxyphenoxy)-dodecaneamido}anilino group, etc.), a ureido group (e.g., a phenylureido group, a methylureido group, an N,N-dibutylureido group, etc.), an imido group (e.g., an N-succinimido group, a 3-benzylhydantoinyl group, a 4-(2-ethylhexanoylamino)phthalimido group, etc.), a sulfamoylamino group (e.g., an N,N-dipropylsulfamoylamino group, an N-methyldecylsulfamoylamino group, etc.), an alkylthio group (e.g., a methylthio group, an octylthio group, a tetradecylthio group, a 2-phenoxyethylthio group, a 3-phenoxypropylthio group, a 3-(4-t-butylphenoxy)propylthio group, etc.), an arylthio group (e.g., a phenylthio group, a 2-butoxy-5-t-octylphenylthio group, a 3-pentadecylphenylthio group, a 2-carboxyphenylthio group, a 4-tetradecaneamidophenylthio group, etc.), a heterocyclic thio group (e.g., a 2-benzothiazolylthio group, etc.), an alkoxycarbonylamino group (e.g., a methoxycarbonylamino group, a tetradecyloxycarbonylamino group, etc.), an aryloxycarbonylamino group (e.g., a phenoxycarbonylamino group, an 2,4-di-t-butylphenoxycarbonylamino group, etc.), a sulfonamido group (e.g., a methanesulfonamido group, a hexadecanesulfonamido group, a benzenesulfonamido group, a p-toluenesulfonamido group, an octadecanesulfonamido group, a 2-methyloxy-5-t-butylbenzenesulfonamido group, etc.), a carbamoyl group (e.g., an N-ethylcarbamoyl group, an N,N-dibutylcarbamoyl group, an N-(2-dodecyloxyethyl)carbamoyl group, an N-methyl-N-dodecylcarbamoyl group, an N-{3-(2,4-di-t-amylphenoxy)propyl}carbamoyl group, etc.), an acyl group (e.g., an acetyl group, a (2,4-di-t-amylphenoxy)acetyl group, a benzoyl group, etc.), a sulfamoyl group (e.g., an N-ethylsulfamoyl group, an N,N-dipropylsulfamoyl group, an N-(2-dodecyloxyethyl)sulfamoyl group, an N-ethyl-N-dodecylsulfamoyl group, an N,N-diethylsulfamoyl group, etc.), a sulfonyl group (e.g., a methanesulfonyl group, an octanesulfonyl group, a benzenesulfonyl group, a toluenesulfonyl group, etc.), a sulfinyl group (e.g., an octanesulfinyl group, a dodecylsulfinyl group, a phenylsulfinyl group, etc.), an alkoxycarbonyl group (e.g., a methoxycarbonyl group, a butyloxycarbonyl group, a dodecylcarbonyl group, an octadecylcarbonyl group, etc.), or an aryloxycarbonyl group (e.g., a phenyloxycarbonyl group, a 3-pentadecyloxy-carbonyl group, etc.).

X' represents a hydrogen atom, a halogen atom (e.g., a chlorine atom, a bromine atom, an iodine atom, etc.), a carboxyl group, a group bonded via an oxygen atom (e.g., an acetoxy group, a propanoyloxy group, a benzoyloxy group, a 2,4-dichlorobenzoyloxy group, an ethoxyoxaloyloxy group, a pyruvoyl group, a cinnamoyloxy group, a phenoxy group, a 4-cyanophenoxy group, a 4-methanesulfonamidophenoxy group, a 4-methanesulfonylphenoxy group, an α-naphthoxy group, a 3-pentadecylphenoxy group, a benzyloxycarbonyloxy group, an ethoxy group, a 2-cyanoethoxy group, a benzyloxy group, a 2-phenethyloxy group, a 2-phenoxyethoxy group, a 5-phenyltetrazolyloxy group, a 2-benzothiazolyloxy group, etc.), a group bonded via a nitrogen atom (e.g., a benzenesulfonamido group, an N-ethyltoluenesulfonamido group, a heptafluorobutaneamido group, a 2,3,4,5,6-pentafluorobenzamido group, an octanesulfonamido group, a p-cyanophenylureido group, an N,N-diethylsulfamoylamino group, a 1-piperidyl group, a 5,5-dimethyl-2,4-dioxo-3-oxazolidinyl group, a 1-benzyl-ethoxy-3-hydantoinyl group, a 2N-1,1-dioxo-3(2H)-oxo-1,2-benzoisothiazolyl group, a 2-oxo-1,2-dihydro-1-pyridinyl group, an imidazolyl group, a pyrazolyl group, a 3,5-diethyl-1,2,4-triazol-1-yl group, a 5- or 6-bromo-benzotriazol-1-yl group, a 5-methyl-1,2,3,4-triazol-1-yl group, a benzimidazolyl group, a 3-benzyl-1-hydantoinyl group, a 1-benzyl-5-hexadecyloxy-3-hydantoinyl group, a 5-methyl-1-tetrazolyl group, etc.), an arylazo group (e.g., a 4-methoxyphenylazo group, a 4-pivaloylaminophenylazo group, a 2-naphthylazo group, a 3-methyl-4-hydroxyphenylazo group, etc.), or a group bonded via a sulfur atom (e.g., a phenylthio group, a 2-carboxyphenylthio group, a 2-methoxy-5-t-octylphenylthio group, a 4-methanesulfonylphenylthio group, a 4-octanesulfonamidophenylthio group, a 2-butoxyphenylthio group, a 2-(2-hexanesulfonylethyl)-5-t-octylphenylthio group, a benzylthio group, a 2-cyanoethylthio group, a 1-ethoxycarbonyltridecylthio group, a 5-phenyl-2,3,4,5-tetrazolylthio group, a 2-benzothiazolylthio group, a 2-dodecylthio-5-thiophenylthio group, a 2-phenyl-3-dodecyl-1,2,4-triazole-5-thio group, etc.).

In formulae (IX) and (X), $R^{12}$ and $R^{13}$ may be bonded together to form a 5- to 7-membered ring.

In the cases where $R^{11}$, $R^{12}$, $R^{13}$ or X' represents a divalent group to form a bis-compound, $R^{11}$, $R^{12}$ or $R^{13}$ preferably represents a substituted or unsubstituted alkylene group (e.g., a methylene group, an ethylene group, α 1,10-decylene group, $-CH_2CH_2-O-CH_2CH_2-$, etc.), a substituted or unsubstituted phenylene group (e.g., a 1,4-phenylene group, a 1,3-phenylene group,

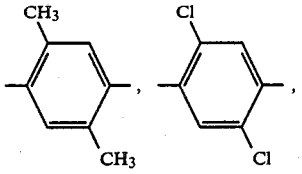

etc.), —NHCO—$R^{14}$—CONH—, wherein $R^{14}$ represents a substituted or unsubstituted alkylene group or a substituted or unsubstituted phenylene group (e.g., —NHCO$CH_2CH_2$CONH—,

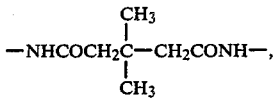

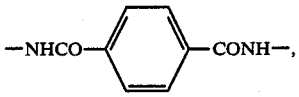

etc.), —S—$R^{15}$—S—, wherein $R^{15}$ represents a substituted or unsubstituted alkylene group (e.g., —S—$CH_2CH_2$—S—,

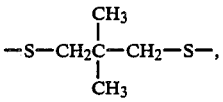

etc.), and X' represents a divalent group appropriately derived from any of the above-enumerated monovalent groups.

When the moiety represented by formulae (IX) to (XV) is contained in the vinyl monomer, the linking group as represented by $R^{11}$, $R^{12}$, $R^{13}$ or X' includes those formed by combining members selected from a substituted or unsubstituted alkylene group (e.g., a methylene group, an ethylene group, a 1,10-decylene group, $-CH_2CH_2OCH_2CH_2-$, etc.), a substituted or unsubstituted phenylene group (e.g., a 1,4-phenylene group, a 1,3-phenylene group,

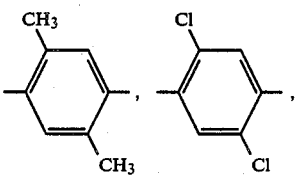

etc.), —NHCO—, —CONH—, —O—, —OCO— and an aralkylene group (e.g.,

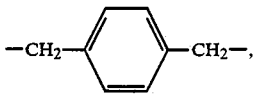

-continued

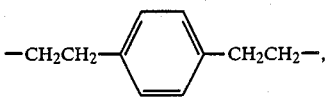

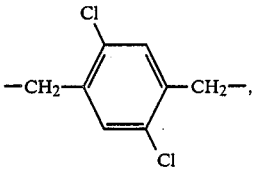

etc.).

Of these linking groups, the preferred groups are —NHCO—, $-CH_2CH_2-$,

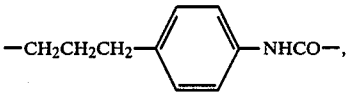

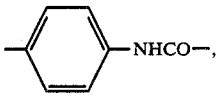

$-CH_2CH_2NHCO-$, $-CH_2CH_2-O-\underset{\underset{O}{\|}}{C}-$,

—CONH—$CH_2CH_2$NHCO—, $-CH_2CH_2O-CH_2CH_2$—NHCO—, and

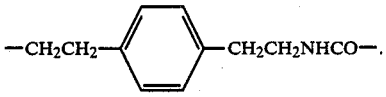

The vinyl group may be substituted with substituents other than those shown by formulae (IX) to (XV), and preferred substituents include a hydrogen atom, a chlorine atom and a lower alkyl group having from 1 to 4 carbon atoms, e.g., a methyl group, an ethyl group, etc.

The monomer containing the moiety represented by formulae (IX) to (XV) may be copolymerized with non-color-forming ethylenical monomers which are not capable of coupling with an oxidation product of an aromatic primary amine developing agent.

Examples of such comonomers include acrylic acid, α-chloroacrylic acid or α-alkylacrylic acids (e.g., methacrylic acid) and esters or amides of these acrylic acids (e.g., acrylamide, n-butylacrylamide, t-butylacrylamide, diacetoneacrylamide, methacrylamide, methyl acrylate, ethyl acrylate, n-propyl acrylate, n-butyl acrylate, t-butyl acrylate, isobutyl acrylate, 2-ethylhexyl acrylate, an n-octyl acrylate, lauryl acrylate, methyl methacrylate, ethyl methacrylate, n-butyl methacrylate, β-hydroxymethacrylate, etc.), methylenebisacrylamide, vinyl esters (e.g., vinyl acetate, vinyl propionate, vinyl laurate, etc.), acrylonitrile, methacrylonitrile, aromatic vinyl compounds (e.g., styrene and its derivatives, vinyltoluene, divinylbenzene, vinylacetophenone, sulfostyrene, etc.), itaconic acid, citraconic acid, crotonic acid, vinylidene chloride, vinyl alkyl ethers (e.g., vinyl ethyl ether, etc.), maleic acid, maleic anhydride, maleic esters, N-vinyl-2-pyrrolidone, N-vinylpyridine, 2- or 4-vinylpyridine, and the like. These non-color-forming ethylenically unsaturated monomers may be used in combination of two or more thereof. For example, a combination of n-butyl acrylate and methyl acrylate, a combination of styrene and methacrylic acid, a combination of methacrylic acid and acrylamide, or a combination of methyl acrylate and diacetoneacrylamide can be used.

As is well known in the field of polymer color couplers, the non-color-forming ethylenically unsaturated monomers to be copolymerized with the solid water-insoluble monomer coupler can be selected so as to exert a favorable influence upon physical and/or chemical properties of the resulting copolymer, such as solubility, compatibility with binders for photographic colloidal compositions, e.g., gelatin, flexibility, thermal stability, and the like.

Polymer couplers which can be used in this invention particularly preferably are polymer coupler latices.

Specific examples of the pyrazoloazole magenta couplers represented by formula (VIII) and processes for synthesizing these magenta couplers are described, e.g., in Japanese Patent Application (OPI) Nos. 162548/84, 43659/85, 171956/84 and 33552/85, Japanese Patent Application No. 27745/84, and U.S. Pat. No. 3,061,432.

Specific examples of the typical magenta couplers which can be used in the present invention and vinyl monomers therefor are shown below for illustrative purposes only and not for limitation.

M-1

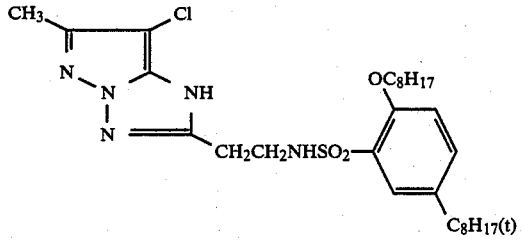

M-2

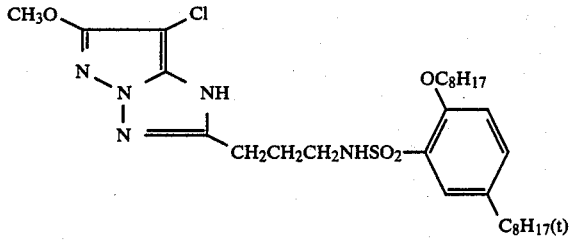

M-3

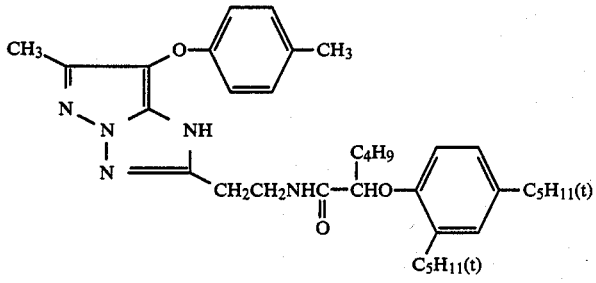

M-4

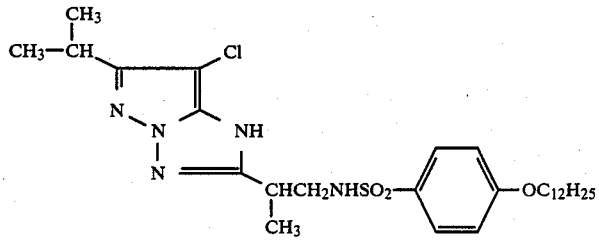

-continued
M-5
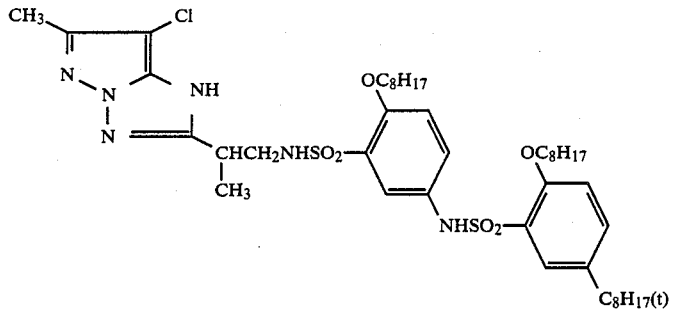
M-6
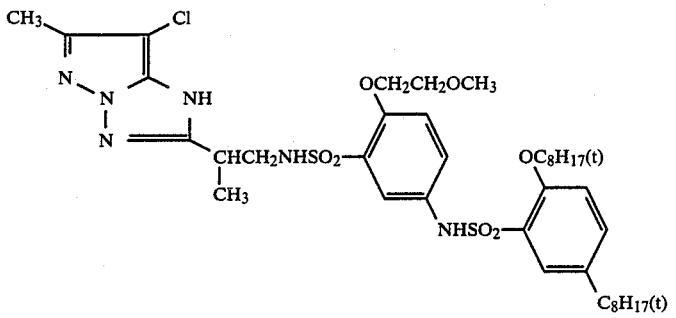
M-7
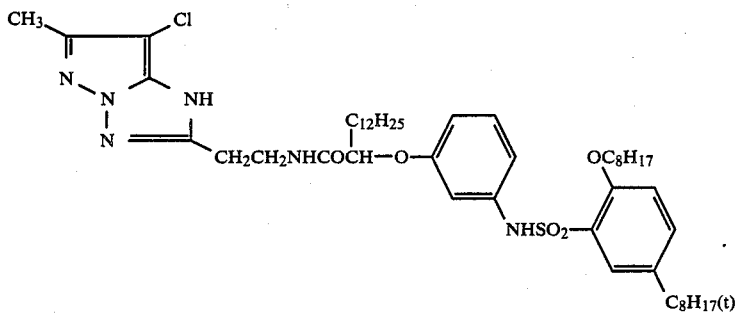
M-8
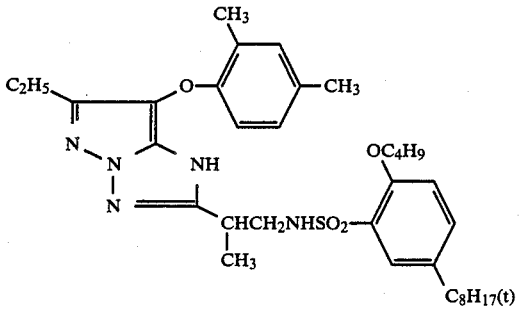
M-9
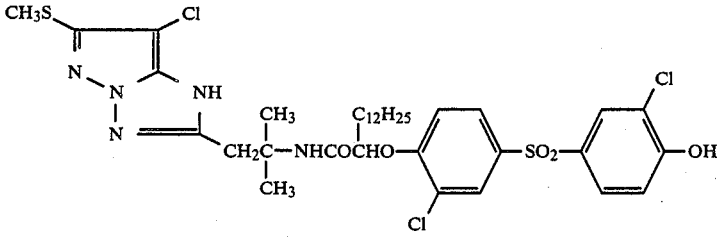

-continued
M-10
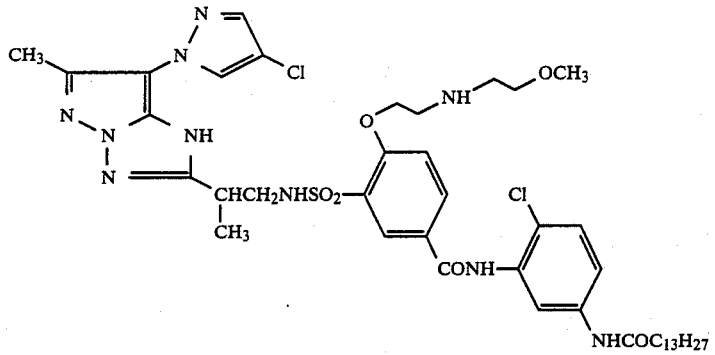
M-11
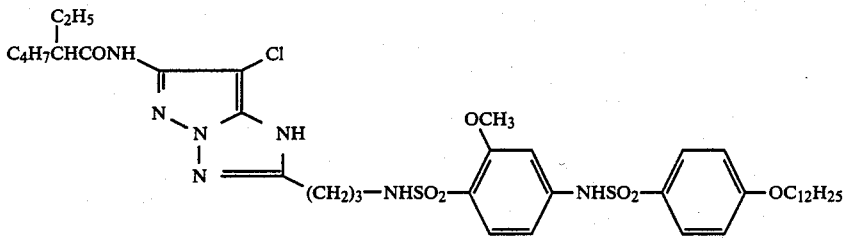
M-12
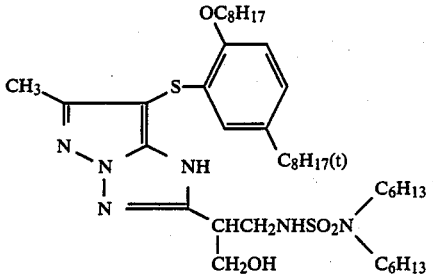
M-13
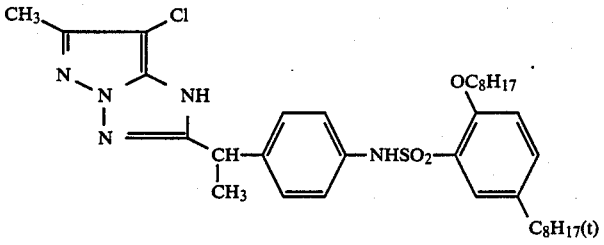
M-14
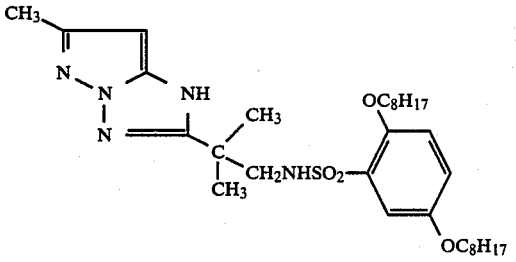
M-15
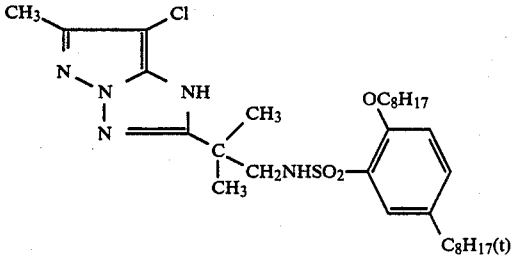

-continued
M-16
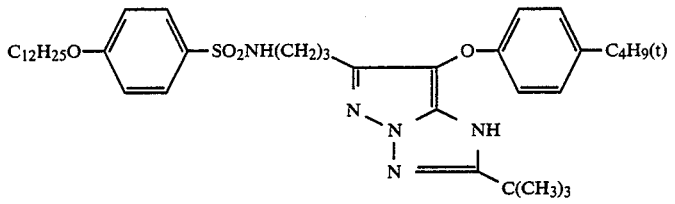
M-17
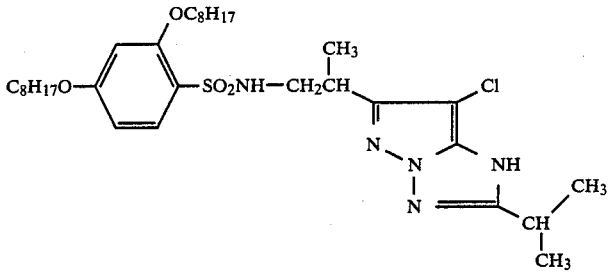
M-18
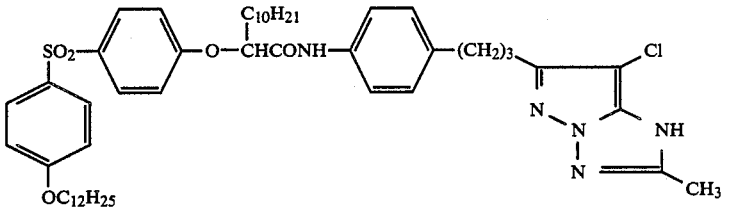
M-19
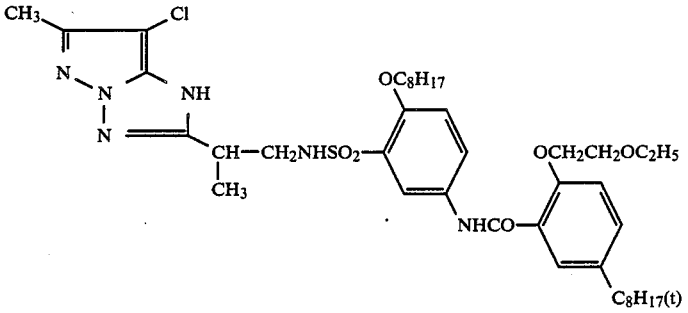
M-20
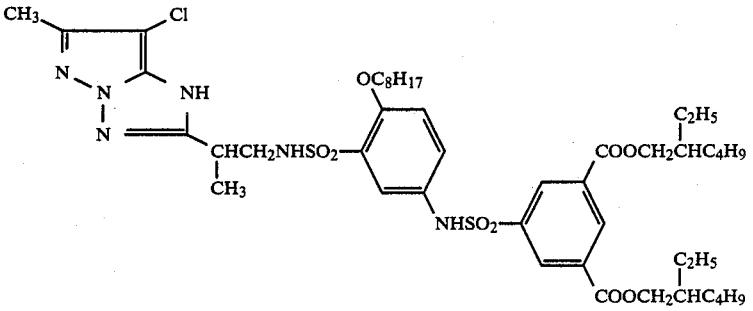
M-21
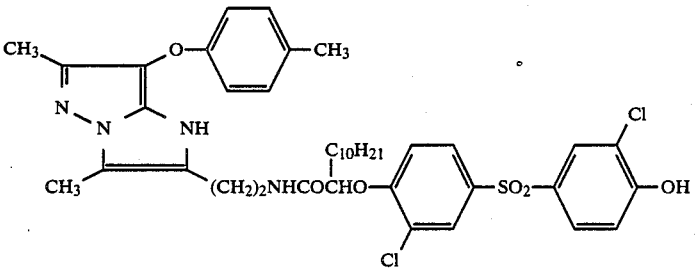

-continued
M-22
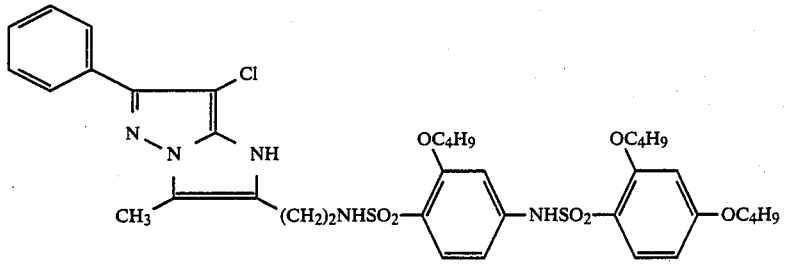
M-23
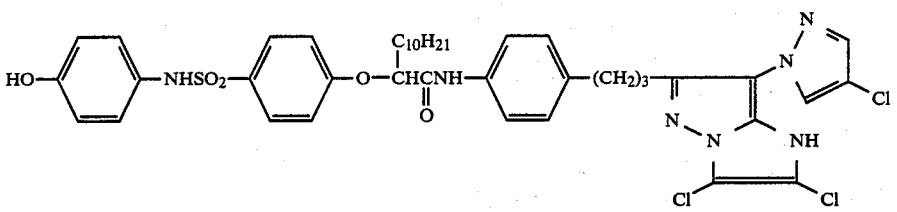
M-24
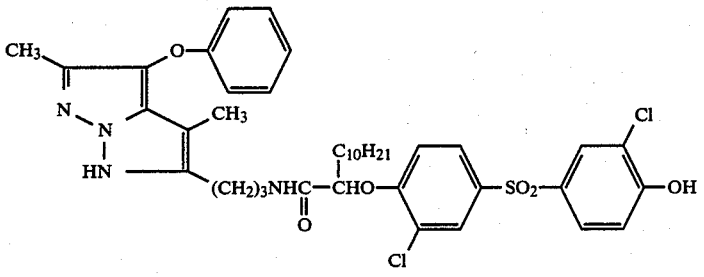
M-25
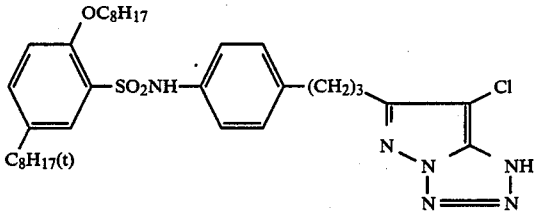
M-26
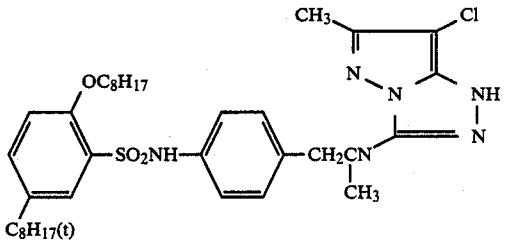
M-27
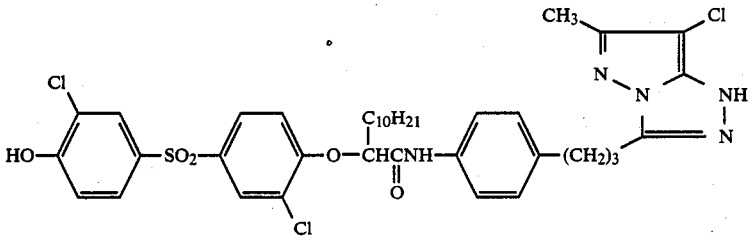

-continued
M-28
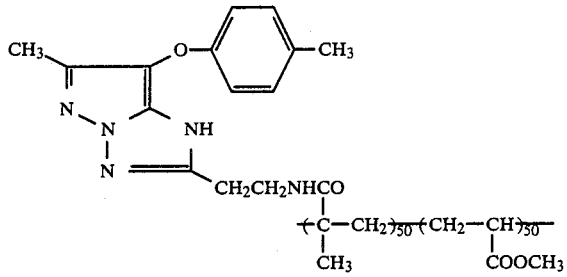
M-29
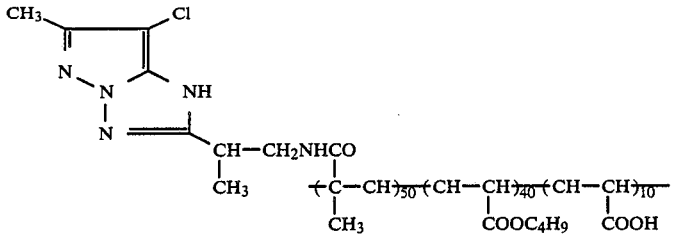
M-30
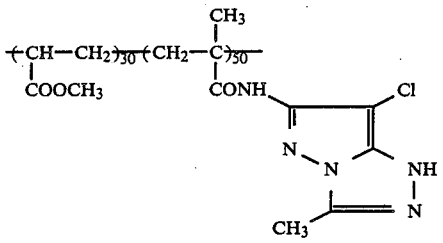
M-31
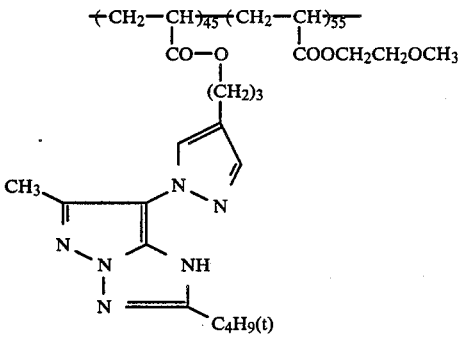
M-32
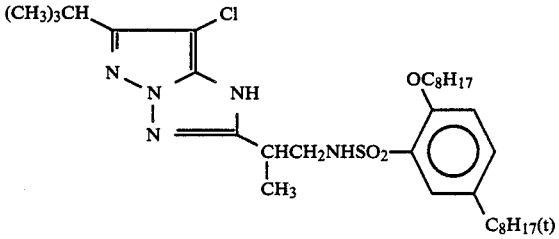
M-33
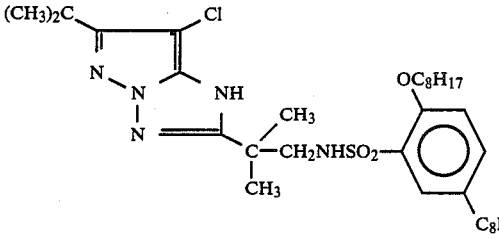

-continued

M-34

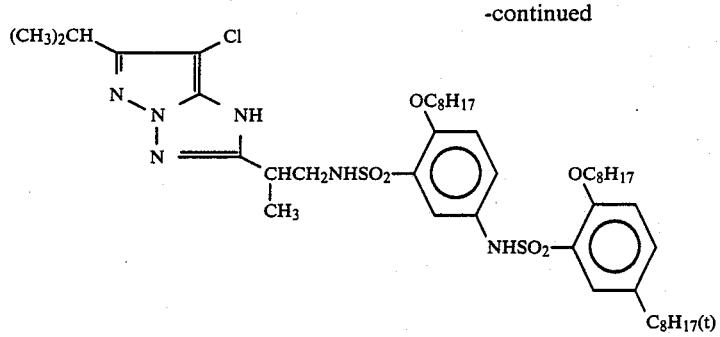

Two or more kinds of these magenta couplers may be incorporated into the same emulsion layer. The magenta couplers represented by formula (VIII) are incorporated in an emulsion layer in a total amount of from $1\times10^{-3}$ to 1 mol, and preferably from $5\times10^{-2}$ mol to $5\times10^{-1}$ mol, per mol of silver halides present in the layer to which the couplers are to be added.

In addition to the above-described magenta couplers, the light-sensitive materials of the present invention can contain cyan and yellow couplers as well. Usable cyan and yellow couplers typically include naphthol or phenol compounds and open-chain or heterocyclic ketomethylene compounds, respectively. Specific examples of these cyan and yellow couplers which can be used in this invention are described in patents cited in *Research Disclosure,* RD No. 17643, VII-D (December, 1978) and ibid., RD No. 18717 (November, 1979).

These color couplers to be incorporated into light-sensitive materials are preferably rendered anti-diffusible by introducing ballast groups or by polymerization. Two-equivalent cyan or yellow couplers that are substituted with a releasable group are preferable to 4-equivalent ones wherein the coupling active site is a hydrogen atom similar to the magenta couplers as described above from the standpoint of reduction in silver coverage required.

Yellow couplers which can be used in the present invention typically include oil-protected type acylacetamide couplers. Specific examples thereof are described, e.g., in U.S. Pat. Nos. 2,407,210, 2,876,057 and 3,265,506. Two-equivalent yellow couplers are preferred in the present invention as described above. Typical examples of the 2-equivalent yellow couplers include oxygen-releasing type yellow couplers as described in U.S. Pat. Nos. 3,408,194, 3,447,928, 3,933,501 and 4,022,620; and nitrogen-releasing type yellow couplers as described in Japanese Patent Publication No. 10739/83, U.S. Pat. Nos. 4,401,752 and 4,326,024, Research Disclosure, RD No. 18053, British Pat. No. 1,425,020, West German Patent Publication Nos. 2,219,917, 2,261,361, 2,329,587 and 2,433,812. Of these, α-pivaloylacetanilide couplers are excellent in fastness, particularly fastness to light of a developed color, and α-benzoylacetanilide couplers provide high color densities.

Cyan couplers which can be used in the present invention include oil-protected type naphthol and phenol couplers. Typical examples are naphthol couplers described in U.S. Pat. No. 2,474,293 and, in particular, oxygen-releasing type 2-equivalent naphthol couplers as described in U.S. Pat. Nos. 4,052,212, 4,146,396, 4,228,233 and 4,296,200. Specific examples of the phenol couplers are described, for example, in U.S. Pat. Nos. 2,369,929, 2,810,171, 2,772,162 and 2,895,826. Cyan couplers whose developed colors are fast to humidity and temperature are preferred in the present invention. Typical examples of such couplers are phenol couplers having an alkyl group having 2 or more carbon atoms at the meta-position of the phenol nucleus as described in U.S. Pat. Nos. 3,772,002; 2,5-diacylamino-substituted phenol couplers as described in U.S. Pat. Nos. 2,772,162, 3,758,308, 4,126,396, 4,334,011 and 4,327,173, West German Patent Publication No. 3,329,729, and Japanese Patent Application (OPI) No. 166956/84; and phenol couplers having a phenylureido group at the 2-position and an acylamino group at the 5-position as described in U.S. Pat. Nos. 3,446,622, 4,333,999, 4,451,559 and 4,427,767.

In addition to the above-described dye image forming couplers, the light-sensitive materials of the present invention can further contain couplers whose developed colors exhibit moderate diffusibility, colorless couplers, DIR couplers capable of releasing developing inhibitors upon a coupling reaction, DAR couplers capable of releasing development accelerators upon a coupling reaction.

In order to satisfy various characteristics required for light-sensitive materials, two or more of the above-described various couplers can be incorporated into one layer, or one of them can be incorporated into two or more different layers.

Incorporation of the couplers into light-sensitive materials can be carried out according to various known dispersion methods, such as solid dispersion, preferably latex dispersion, and more preferably oil-in-water dispersion. According to the oil-in-water dispersion method, couplers are dissolved in a high-boiling organic solvent having a boiling point of 175° C. or more an/or a low-boiling solvent (the so-called auxiliary solvent), and the resulting solution is finely dispersed in an aqueous medium, such as water, a gelatin aqueous solution, etc., in the presence of a surface active agent. Specific examples of the high-boiling organics solvents and low-boiling solvents to be used here have been described.

The standard amount of the color couplers to be used ranges from 0.001 to 1 mol per mol of light-sensitive silver halide. In a preferred range, the amount of yellow coupler is from 0.01 to 0.5 mol, and the amount of cyan coupler is from 0.002 to 0.3 mol per mol of light-sensitive silver halide.

Silver halide emulsions which can be used in the present invention can be prepared usually by mixing a solution of an aqueous silver salt (e.g., silver nitrate) and a solution of a water-soluble halogen salt (e.g., potassium bromide, sodium chloride, potassium iodide or a mixture thereof) in the presence of a water-soluble high polymer solution (e.g., a gelatin aqueous solution).

Silver halide grains may have a heterogeneous composition comprising a core and an outer shell or multiphases having a fused structure, or a homogeneous composition throughout the individual grains, or a combination thereof. For example, silver chlorobromide grains may have a core or a single or plurality of layers rich in silver bromide over an averaged halogen composition in the inner portion thereof, or they may have a core or a single or plurality of layers rich in silver chloride over an averaged halogen composition in the inner portion thereof.

The mean grain size of the silver halide grains is preferably from 2 to 0.1 μm, and more preferably from 1 to 0.15 μm. The term "mean grain size" as used herein means a grain diameter in the case of spherical or near spherical grains or an edge length in the case of cubic grains, both averaged based on the projected area. The grain size distribution may be either narrow or broad.

A so-called mono-dispersed silver halide emulsion can be used in the invention. The degree of mono-dispersion is expressed in terms of the coefficient of variation obtained by dividing a standard derivation derived from a grain size distribution curve of silver halide by a mean grain size. The coefficient of variation in grain size is preferably not more than 15%, and more preferably not more than 10%. In order to satisfy the desired gradation, two or more mono-dispersed silver halide emulsions having different grain sizes can be mixed and incorporated into one of the layers having substantially the same color sensitivity, or each of them may be coated in independent layers. Further, two or more poly-dispersed silver halide emulsions or a combination of a mono-dispersed emulsion and a poly-dispersed emulsion may be mixed or independently coated.

The silver halide grains to be used in this invention may have a regular crystal form, such as a cube, an octahedron, a dodecahedron, a tetradecahedron, etc., or an irregular crystal form, such as a sphere, etc., or a composite form thereof. Plate grains having a diameter/thickness ratio of 5 or more, and particularly 8 or more, may occupy 50% or more of the total projected area of grains. The emulsion may be a mixture of emulsions having different crystal forms. The emulsion may be either a surface latent image emulsion wherein a latent image is predominantly formed on the grain surface or an inner latent image emulsion wherein a latent image is predominantly formed in the inner portion of grains.

The photographic emulsion which can be used in the present invention can be prepared by any of known processes as described in P. Glafkides, *Chimie et Physique Photographique,* Paul Montel (1967), G. F. Duffin, *Photographic Emulsion Chemistry,* The Focal Press (1966), V. L. Zelikman, et al, *Making and Coating Photographic Emulsion,* The Focal Press (1964), etc. In some detail, the emulsion can be prepared by an acid process, a neutral process, an ammonia process, etc. The reaction between a soluble silver salt and a soluble halogen salt can be carried out by a single jet process, a double jet process or a combination thereof. A so-called reverse mixing process, in which grains are formed in the presence of excess silver ions, may be used. A conversion process involving addition of a halogen salt for forming more sparingly soluble silver halides may also be used. Further, a so-called controlled double jet process, in which a pAg in the liquid phase wherein silver halide grains are formed is maintained constant, can be used to advantage. According to this process, silver halide emulsions having a regular crystal form and a nearly uniform grain size can be obtained.

During the course of grain formation or physical ripening, a cadmium salt, a zinc salt, a lead salt, a thallium salt, an iridium salt or a complex salt thereof, a rhodium salt or a complex salt thereof, an iron salt or a complex salt thereof, etc. may also be present.

The silver halide emulsions thus prepared are generally subjected to physical ripening, desalting and chemical ripening before coating.

During the precipitation, physical ripening or chemical ripening steps, known silver halide solvents, such as ammonia, potassium rhodanide, thioether or thione compounds described in U.S. Pat. No. 3,271,157 and Japanese Patent Application (OPI) Nos. 12360/75, 82408/78, 144319/78, 100717/79 and 155828/79, etc., may be employed. Removal of soluble silver salts from emulsions after physical ripening can be effected by the noodle washing method, the sedimentation method, the ultrafiltration method, and the like.

The photographic emulsions to be used in this invention may be spectrally sensitized with methine dyes or others if desired.

For the purpose of preventing fog during preparation, preservation or photographic processing or stabilizing photographic performance properties, the photographic emulsions to be used in this invention can contain various compounds.

The light-sensitive materials prepared by the present invention may contain hydroquinone derivatives, aminophenol derivatives, amines, gallic acid derivatives, catechol derivatives, ascorbic acid derivatives, colorless couplers, sulfonamidophenol derivatives, and the like as color fog preventing agents or color mixing preventing agents.

The light-sensitive materials of the present invention may further contain a wide variety of discoloration inhibitors.

The light-sensitive materials of the invention may furthermore contain ultraviolet absorbents in the hydrophilic colloidal layers.

The light-sensitive materials may also contain one or more surface active agents for various purposes, such as for a coating aid, static charge prevention, improvement of slipperiness, an emulsion and dispersion aid, prevention of adhesion, improvement of photographic characteristics, for example, development acceleration, increase in contrast and increase in sensitivity, and the like.

In addition, the light-sensitive materials according to the present invention may contain various stabilizers, stain preventing agents, developing agents or precursors thereof, lubricants, mordants matting agents, antistatics, plasticizers, and any other additives useful for photographic light-sensitive materials. Typical examples of these additives are described in *Research Disclosure,* RD No. 17643 (December, 1978) and ibid., RD No. 18716 (November, 1979).

The present invention can be applied to multilayer multi-color photographic materials comprising a support having provided thereon at least two layers being different in spectral sensitivity. Multilayer natural color photographic materials generally comprise a support having provided thereon at least one red-sensitive emulsion layer, at least one green-sensitive emulsion layer and at least one blue-sensitive emulsion layer. The order of these layers is arbitrarily selected according to necessity. Each of the red, green and blue-sensitive emulsions may comprise two or more layers being different in sensitivity. A light-insensitive layer may be provided between a pair of emulsion layers having the same light sensitivity.

The light-sensitive materials according to the present invention preferably contain appropriate auxiliary layers, such as a protective layer, an intermediate layer, a filter layer, an antihalation layer, a backing layer, etc., in addition to the silver halide emulsion layer.

The photographic emulsion layers and other layers are coated on a flexible support commonly employed for photographic light-sensitive materials, such as a plastic film, paper, cloth, etc., or a rigid support, such as glass, ceramics, metals, etc. Among these supports, the preferred are baryta paper and paper supports laminated with polyethylene having dispersed therein a white pigment, e.g., titanium dioxide.

The present invention is applicable to a variety of light-sensitive materials typically including color negative films for general use or for movies, color papers, color positive films, color reversal papers, and the like. The present invention can also be applied to black-and-white light-sensitive materials utilizing three color coupler mixing as described in *Research Disclosure,* RD No. 17123 (July, 1978).

A color developer which can be used for development processing of the light-sensitive materials is preferably an alkaline aqueous solution containing an aromatic primary amine color developing agent as a main ingredient. The color developing agent to be used preferably includes p-phenylenediamine compounds. Typical examples of the p-phenylenediamine compounds are 3-methyl-4-amino-N,N-diethylaniline, 3-methyl-4-amino-N-ethyl-N-$\beta$-hydroxyethylaniline, 3-methyl-4-amino-N-ethyl-N-$\beta$-methanesulfonamidoethylaniline, 3-methyl-4-amino-N-ethyl-N-$\beta$-methoxyethylaniline and sulfates, hydrochlorides or p-toluenesulfonates of these compounds.

The color developer generally contains additives, such as preservatives, e.g., alkali metal sulfites, hydroxylamines, etc.; pH-buffering agents, e.g., alkali metal carbonates, borates or phosphates, etc.; development restrainers or antifoggants, e.g., bromides, iodides, benzimidazoles, benzothiazoles, mercapto compounds, etc.; organic solvents, e.g., benzyl alcohol, diethylene glycol, etc.; polyethylene glycol; quaternary ammonium salts; development accelerators, e.g., amines; and the like.

After color development, the photographic emulsions are usually subjected to bleaching. Bleaching may be effected simultaneously with fixation, or these two processing steps may be effected separately. Bleaching agents to be used include compounds of polyvalent metals, e.g., iron (III), cobalt (III), chromium (VI), copper (II), etc., peracids, quinones, nitroso compounds, and the like. Typical examples of usable bleaching agents are ferricyanides; bichromates; organic complex salts of iron (III) or cobalt (III), such as complex salts formed by iron (III) or cobalt (III) and aminopolycarboxylic acids, e.g., ethylenediaminetetraacetic acid, diethylenetriaminepentaacetic acid, nitrilotriacetic acid, 1,3-diamino-2-propanoltetraacetic acid, etc., or organic acids, e.g., citric acid, tartaric acid, malic acid, etc., persulfates; permanganates; nitrosophenol; and the like. Of these, (ethylenediaminetettraacetato) iron (III) salts and persulfates are preferred for achievement of rapid processing and prevention of environmental pollution. The (ethylenediaminetetraacetate) iron (III) complex salts are particularly useful both in an independent bleaching bath and in a bleach-fix bath.

The bleaching solution or bleach-fixing solution can contain, if desired, various accelerators.

The bleach-fixing or fixing is usually followed by washing with water. For the purpose of preventing precipitation or saving water, various known additives can be used in the washing step. For example, water softeners for the prevention of precipitation, e.g., inorganic phosphoric acids, aminopolycarboxylic acids, organic phosphoric acids, etc.; bacteriocides or fungicides for preventing growth of various bacteria, algae or mold; hardening agents, e.g., magnesium salts and aluminum salts; surface active agents for reduction of drying load or prevention of uneven drying; and the like can be added to water according to necessity. The compounds described in L. E. West, *Water Quality Criteria, Photo. Sci. Eng.,* Vol. 6, pp. 344–359 (1965) can also be used. Particularly, addition of chelating agents or fungicides is effective.

The washing step is generally carried out with two or more tanks aligned in a countercurrent system to save water. The washing step may be substituted by a multilayer countercurrent stabilization step as described in Japanese Patent Application (OPI) No. 8543/82. For the purpose of image stabilization, the stabilization bath can contain various compounds, such as buffering agents for pH adjustment to, for example, 3 to 8 (e.g., borates, metaborates, borax, phosphates, carbonates, potassium hydroxide, sodium hydroxide, aqueous ammonia, monocarboxylic acids, dicarboxylic acids, polycarboxylic acids, and combinations thereof) and formalin. If desired, the stabilization bath may further contain water softeners (e.g., inorganic phosphoric acids, aminopolycarboxylic acids, organic phosphoric acids, aminopolyphosphonic acids, phosphonocarboxylic acids, etc.), bacteriocides (e.g., benzoisothiazolinone, isothiazolone, 4-thiazolinebenzimidazole, halogenated phenols, etc.), surface active agents, fluorescent brightening agents, hardening agents, and the like. Two or more of these additives for the same or different purposes may be used in combination.

It is preferable to add, as a film pH-adjustor after processing, various ammonium salts, e.g., ammonium chloride, ammonium nitrate, ammonium sulfate, ammonium phosphate, ammonium sulfite, ammonium thiosulfate, etc.

If desired, the light-sensitive materials of the present invention may contain various 1-phenyl-3-pyrazolidones for the purpose of accelerating color development. Typical examples of such compounds are described in Japanese Patent Application (OPI) Nos. 64339/81, 144547/82, 211147/82, 50536/83 and 115438/83, etc.

Each of the above-described processing solution is generally used at a temperature of from 10° to 50° C., and preferably from 33° to 38° C. Processing with a cobalt intensifier or a hydrogen peroxide intensifier as described in West German Pat. No. 2,226,770 or U.S. Pat. No. 3,674,499 may be performed for saving silver.

If desired, each of the processing baths may be equipped with a heater, a temperature sensor, a liquid level sensor, a circulatory pump, a filter, a floating lid, a squeegee, etc.

This invention will now be illustrated in greater detail with reference to the following examples, but it should be understood that they are not intended to limit the present invention.

EXAMPLE 1

A double-side polyethylene-laminated paper support was coated with first (undermost) to seventh (uppermost) layers as shown below to prepare a photographic light-sensitive materials for a control.

| | |
|---|---|
| First Layer (Blue-Sensitive Layer): | |
| Mixed silver chlorobromide emulsion as described in Table below | 400 mg-Ag/m$^2$ |
| Yellow coupler (*a) | 690 g/m$^2$ |
| Dibutyl phthalate | 500 mg/m$^2$ |
| Gelatin | 1200 mg/m$^2$ |
| Second Layer (Color Mixing Preventing Layer): | |
| 2,5-Dioctylhydroquinone | 400 mg/m$^2$ |
| Dibutyl phthalate | 100 mg/m$^2$ |
| Gelatin | 1000 mg/m$^2$ |
| Third Layer (Green-Sensitive Layer): | |
| Mixed silver chlorobromide emulsion as described in Table below | 180 mg-Ag/m$^2$ |
| Magenta Coupler M-5 | 400 g/m$^2$ |
| 3,3,3',3'-Tetramethyl-5,6,5',6'-tetrapropyloxy-bis-1,1'-spiroindane | 220 mg/m$^2$ |
| Tricresyl phosphate | 250 mg/m$^2$ |
| Trioctyl phosphate | 500 mg/m$^2$ |
| Sodium 2-sulfo-5-n-pentadecyl-hydroquinone | 18 mg/m$^2$ |
| Gelatin | 1200 mg/m$^2$ |
| Fourth Layer (Color Mixing Preventing Layer): | |
| 2,5-Dioctylhydroquinone | 200 mg/m$^2$ |
| Ultraviolet absorbent (*b) | 200 mg/m$^2$ |
| Dibutyl phthalate | 60 mg/m$^2$ |
| Gelatin | 1000 mg/m$^2$ |
| Fifth Layer (Red-Sensitive Layer): | |
| Mixed silver chlorobromide emulsion as described in Table below | 250 mg-Ag/m$^2$ |
| Cyan coupler (*c) | 400 g/m$^2$ |
| Ultraviolet absorbent (*b) | 150 mg/m$^2$ |
| Dibutyl phthalate | 240 mg/m$^2$ |
| Gelatin | 600 mg/m$^2$ |
| Sixth Layer (Ultraviolet Absorbing Layer): | |
| Ultraviolet absorbent (*b) | 200 mg/m$^2$ |
| Dibutyl phthalate | 60 mg/m$^2$ |
| Gelatin | 1000 mg/m$^2$ |
| Seventh Layer (Protective Layer): | |
| Gelatin | 1600 mg/m$^2$ |

TABLE

| Mixed Silver Chlorobromide | Mean Grain Size ($\bar{\gamma}$) Measured by Projected Area Method | Coefficient of Variation (S/$\bar{\gamma}$)* | Mixed Ratio (by weight) | Silver Bromide content (mol %) |
|---|---|---|---|---|
| First Layer | | | | |
| Em 1 | 1 μm | 0.08 | 1/1 | 80 |
| Em 2 | 0.75 μm | 0.07 | | 80 |
| Third Layer | | | | |
| Em 3 | 0.5 μm | 0.09 | 3/7 | 70 |
| Em 4 | 0.4 μm | 0.10 | | 70 |
| Fifth Layer | | | | |
| Em 5 | 0.5 μm | 0.09 | 3/7 | 70 |
| Em 6 | 0.4 μm | 0.10 | | 70 |

*S stands for statistic standard deviation

Compounds (*a) to (*c) used above are shown below:

Yellow coupler (*a):

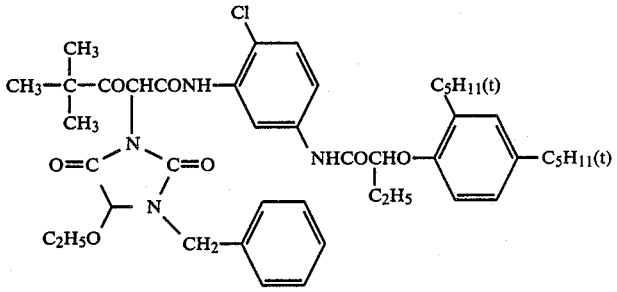

Ultraviolet absorbent (*b): A 1:5:3 (by mol) mixture of

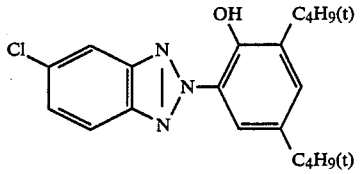

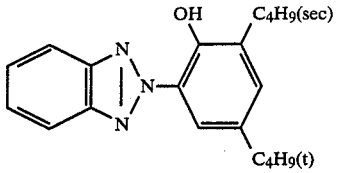

and

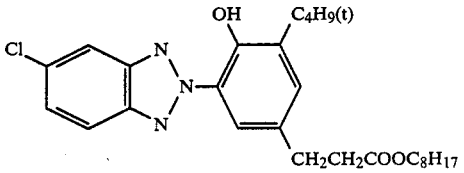

Cyan coupler (*c): A 1:1 (by mol) mixture of

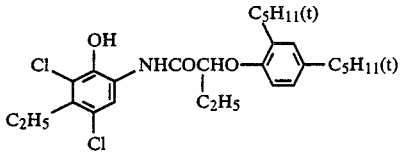

-continued

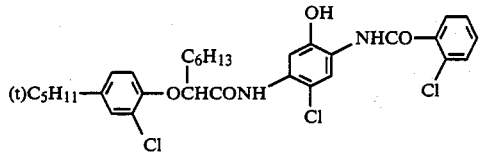

The resulting sample was designated as Sample A.

Sample B was prepared in the same manner as Sample A, except that the third layer further contained di-t-octylhydroquinone as a comparative compound in an amount of 30 mol% based on the coupler in the lipophilic fine particles containing the coupler.

Sample C was prepared in the same manner as Sample A, except that the third layer further contained water-soluble sodium p-toluenesulfinate as a comparative compound in an amount of 30 mol% based on the coupler.

Sample D was prepared in the same manner as Sample A, except that the third layer further contained a water-soluble sulfinic acid homopolymer having a repeating unit of formula:

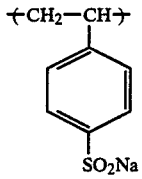

as a comparative compound in an amount of 30 mg/m$^2$.

Samples E to J according to the present invention were prepared in the same manner as Sample A, except that the third layer further contained Compounds I-9, I-11, I-32, I-33, I-34 and I-73, respectively, in an amount of 30 mol% based on the coupler in the same lipophilic fine particles as containing the coupler.

Each of Samples A to J was exposed to light through an optical wedge and subjected to development processing according to the following instructions. It should be noted that formulations of the processing solutions used herein are designed so that the developing agent or other components are very apt to remain in the processed materials to cause strains in order to show that the effects of the present invention are outstanding.

| Processing Step | Temperature | Time |
|---|---|---|
| Color Development | 33° C. | 3'30" |
| Bleach-Fixing | 33° C. | 1'30" |
| Washing | 20–25° C. (with no stirring) | 1' |
| Drying | 50–80° C. | 2' |

| Color Developing Solution Formulation: | |
|---|---|
| Trisodium nitrilotriacetate | 2.0 g |
| Benzyl alcohol | 15 ml |
| Diethylene glycol | 10 g |
| Sodium sulfite | 0.5 g |
| Potassium bromide | 0.5 g |
| Hydroxylamine sulfate | 3.0 g |
| 4-Amino-3-methyl-N—ethyl-N—[β-(methanesulfonamido)ethyl]-p-phenylenediamine sulfate | 7.0 g |
| Sodium carbonate monohydrate | 30 g |
| Water to make | 1000 ml (pH = 10.1) |
| **Bleach-Fixing Solution Formulation:** | |
| Color developing solution having the same formulation as above | 400 ml |
| Ammonium thiosulfate (70 wt %) | 150 ml |
| Sodium sulfite | 12 g |
| Sodium (ethylenediaminetetraacetato) iron | 36 g |
| Disodium ethylenediaminetetraacetate | 4 g |
| Water to make | 1000 ml |
| 1N Sulfuric acid to adjust to | pH = 7.0 |

The bleach-fixing solution was used after one hour of aeration.

The above-described bleach-fixing solution was so designed as to present deteriorated conditions arising from, for example, the carry-over of the color development agent being adhered to the light-sensitive material into the bleach-fixing solution.

After one hour from the processing, the density of the non-image area of each processed sample was determined with green light. The samples were allowed to stand at 40° C. and 70% RH for 2 weeks or at room temperature for 35 days, and the densities of the non-image area was again determined with green light to examine increases of stains on non-image areas. The results obtained are shown in Table 1.

TABLE 1

| Sample No. | Compound Added | Increase in Stain Density: 40° C., 70% RH 2 Weeks | Increase in Stain Density: Room Temp. 35 Days | Remark |
|---|---|---|---|---|
| A | — | 0.19 | 0.14 | Control |
| B | di-t-octylhydroquinone | 0.15 | 0.12 | Comparison |
| C | sodium p-toluenesulfinate | 0.17 | 0.12 | " |
| D | sulfinic polymer | 0.15 | 0.11 | " |
| E | I-9 | 0.05 | 0.03 | Invention |
| F | I-11 | 0.06 | 0.02 | " |
| G | I-32 | 0.04 | 0.03 | " |
| H | I-33 | 0.05 | 0.02 | " |
| I | I-34 | 0.04 | 0.03 | " |
| J | I-73 | 0.04 | 0.02 | " |

It can be seen from Table 1 that the water-insoluble lipophilic compounds represented by formula (I) according to the present invention exert great effects on the prevention of stains due to aging after processing as compared with conventionally known reducing agents, such as hydroquinones, etc., water-soluble sulfinic acid salts or sulfinic acid polymers. Further, the effect of the stain prevention could also be exerted when the compounds of formula (I) are contained in lipophilic fine particles containing yellow couplers or cyan couplers.

EXAMPLE 2

Each of Samples A to J as prepared in Example 1 was exposed to light through an optical wedge and subjected to color development according to the following instructions.

| Processing Step (at 33° C.) | Time |
|---|---|
| Color Development | 3'30" |
| Bleach-Fixing | 1'30" |
| Washing | 3' |
| Drying (at 50 to 80° C.) | 2' |

| Color Development Solution Formulation: | |
|---|---|
| Benzyl alcohol | 12 ml |
| Diethyl glycol | 5 ml |
| Potassium carbonate | 25 g |
| Sodium chloride | 0.1 g |
| Sodium bromide | 0.5 g |
| Anhydrous sodium sulfite | 2 g |
| Hydroxylamine sulfate | 2 g |
| Fluorescent brightening agent | 1 g |
| N—Ethyl-N—β-methanesulfonamidoethyl-3-methyl-4-aminoaniline sulfate | 4 g |
| Water to make | 1000 ml |
| | pH = 10.2 |
| **Bleach-Fixing Solution Formulation:** | |
| Ammonium thiosulfate | 124.5 g |
| Sodium metabisulfite | 13.3 g |
| Anhydrous sodium sulfite | 2.7 g |
| Ammonium (ethylenediaminetetra-acetato)ferrite | 65 g |
| Color developing solution having the same formulation as above | 100 ml |
| Water to make | 1000 ml |
| | (pH = 6.7-6.8) |

The above processing solutions are designed so as to equal those which have been used for processing in a usual roller transport type developing machine with normal replenishment and have come to equilibrium.

Each of the thus processed samples was evaluated for stain formation on the background in the same manner as in Example 1. The results obtained are shown in Table 2 below.

TABLE 2

| Sample No. | Compound Added | Increase in Stain Density: 40° C., 70% RH 2 Weeks | Increase in Stain Density: Room Temp. 35 Days | Remark |
|---|---|---|---|---|
| A | — | 0.10 | 0.07 | Control |
| B | di-t-octylhydroquinone | 0.08 | 0.06 | Comparison |
| C | sodium p-toluenesulfinate | 0.09 | 0.06 | " |
| D | sulfinic polymer | 0.08 | 0.05 | " |
| E | I-9 | 0.02 | 0.01 | Invention |
| F | I-11 | 0.03 | 0.01 | " |
| G | I-32 | 0.02 | 0.02 | " |
| H | I-33 | 0.03 | 0.01 | " |
| I | I-34 | 0.02 | 0.02 | " |
| J | I-73 | 0.02 | 0.01 | " |

As can be seen from Table 2, the water-insoluble lipophilic compounds according to the present invention exert marked effects on the prevention of stain formation due to aging after processing as compared with conventionally known reducing agents, such as hydroquinones, etc., water-soluble sulfinic acid salts or sulfinic acid polymers.

EXAMPLE 3

Each of Samples A to J as prepared in Example 1 was exposed to light through an optical wedge and subjected to development processing according to the following instructions, in which the steps and processing solutions were so designed as to present a running equilibrium state during rapid processing.

| Processing Step | Temperature | Time |
|---|---|---|
| Color Development | 37° C. | 1'40" |
| Bleach-Fixing | 33° C. | 1'00" |
| Washing (1)** | 30° C. | 20" |
| Washing (2)** | 30° C. | 20" |
| Washing (3)** | 30° C. | 20" |
| Drying | 80° C. | 1'00" |

| Color Developing Solution Formulation: | |
|---|---|
| Water | 800 ml |
| Diethylenetriaminepentaacetic acid | 3.0 g |
| Benzyl alcohol | 15 ml |
| Diethylene glycol | 10 ml |
| Sodium sulfite | 2.0 g |
| Potassium bromide | 0.5 g |
| Potassium carbonate | 30.0 g |
| N—ethyl-N—(β-methanesulfonamido-ethyl)-3-methyl-4-aminoaniline sulfate | 5.5 g |
| Hydroxylamine sulfate | 4.0 g |
| Fluorescent brightening agent (stilbene type) | 1.0 g |
| Water to make | 1000 ml |
| **Bleach-Fixing Solution Formulation:** | |
| Ammonium thiosulfate (70 wt %) | 200 ml |
| Sodium sulfite | 18 g |
| Ammonium(ethylenediaminetetra-acetato) iron (III) | 65 g |
| Disodium ethylenediaminetetraacetate | 5 g |
| Color developing solution having the same formulation as above | 350 ml |
| Water to make | 1000 ml |
| | (pH = 7.00) |

Note:
*Ten seconds for transfer between baths is included.
**Water was made to flow countercurrently in the direction of 3 → 2 → 1.

Each of the thus processed samples was evaluated for stain formation in the same manner as in Example 1, and the results obtained are shown in Table 3.

TABLE 3

| Sample No. | Compound Added | Increase on Stain Density: 40° C., 70% RH 2 Weeks | Increase on Stain Density: Room Temp. 35 Days | Remark |
|---|---|---|---|---|
| A | — | 0.09 | 0.07 | Control |
| B | di-t-octylhydroquinone | 0.07 | 0.06 | Comparison |
| C | sodium p-toluenesulfinate | 0.08 | 0.06 | " |
| D | sulfinic polymer | 0.07 | 0.05 | " |
| E | I-9 | 0.02 | 0.01 | Invention |
| F | I-11 | 0.03 | 0.01 | " |
| G | I-32 | 0.02 | 0.01 | " |

TABLE 3-continued

| Sample No. | Compound Added | Increase on Stain Density 40° C., 70% RH 2 Weeks | Room Temp. 35 Days | Remark |
|---|---|---|---|---|
| H | I-33 | 0.02 | 0.01 | " |
| I | I-34 | 0.02 | 0.01 | " |
| J | I-73 | 0.02 | 0.01 | " |

As can be seen from Table 3, the water-soluble lipophilic compounds according to the present invention show marked effects on the prevention of stain formation due to aging after processing as compared with conventionally known reducing agents, such as hydroquinones, etc., water-soluble sulfinic acid salts or sulfinic acid polymers.

EXAMPLE 4

A photographic light-sensitive material was prepared by coating the following first (undermost) to 11th (uppermost) layers on a paper support laminated on both sides thereof with polyethylene. The polyethylene laminate on the side to be coated contained titanium white as a white pigment and a trace amount of ultramarine as a blue dye.

| | |
|---|---|
| 1st Layer (antihalation Layer): | |
| Black colloidal silver | 0.01 g-Ag/m$^2$ |
| Gelatin | 0.2 g/m$^2$ |
| 2nd Layer (Low-Sensitive Red-Sensitive Layer): | |
| Silver iodobromide emulsion spectrally sensitized with red sensitizing dye *5, *4 (silver iodide: 3.5 mol %; mean grain size: 0.7 μm) | 0.15 g-Ag/m$^2$ |
| Gelatin | 1.0 g/m$^2$ |
| Cyan coupler *3 | 0.30 g/m$^2$ |
| Discoloration inhibitor *2 | 0.15 g/m$^2$ |
| Coupler solvent *15, *1 | 0.06 g/m$^2$ |
| 3rd Layer (High-Sensitive Red-Sensitive Layer): | |
| Silver iodobromide emulsion spectrally sensitized with red sensitizing dyes *5, *4 (silver iodide: 8.0 mol %; mean grain size: 0.7 μm) | 0.10 g-Ag/m$^2$ |
| Gelatin | 0.50 g/m$^2$ |
| Cyan coupler *3 | 0.10 g/m$^2$ |
| Discoloration inhibitor *2 | 0.05 g/m$^2$ |
| Coupler solvent *15, *1 | 0.02 g/m$^2$ |
| 4th Layer (Intermediate Layer): | |
| Yellow colloidal silver | 0.02 g-Ag/m$^2$ |
| Gelatin | 1.00 g/m$^2$ |
| Color mixing preventing agent *14 | 0.08 g/m$^2$ |
| Solvent for color mixing preventing agent *13 | 0.16 g/m$^2$ |
| Polymer latex *6 | 0.40 g/m$^2$ |
| 5th Layer (Low-Sensitive Green-Sensitive Layer): | |
| Silver iodobromide emulsion spectrally sensitized with green sensitizing dye *12 (silver iodide: 2.5 mol %; mean grain size: 0.4 μm) | 0.20 g-Ag/m$^2$ |
| Gelatin | 0.70 g/m$^2$ |
| Magenta coupler *11 | 0.40 g/m$^2$ |
| Discoloration inhibitor A *10 | 0.05 g/m$^2$ |
| Discoloration inhibitor B *9 | 0.05 g/m$^2$ |
| Discoloration inhibitor C *8 | 0.02 g/m$^2$ |
| Coupler solvent *18 | 0.60 g/m$^2$ |
| 6th Layer (High-Sensitive Green-Sensitive Layer): | |
| Silver iodobromide emulsion spectrally sensitized with green sensitizing dye *12 (silver iodide: 3.5 mol %; mean grain size: 0.9 μm) | 0.20 g-Ag/m$^2$ |
| Gelatin | 0.70 g/m$^2$ |
| Magenta coupler *11 | 0.40 g/m$^2$ |
| Discoloration inhibitor A *10 | 0.05 g/m$^2$ |

-continued

| | |
|---|---|
| Discoloration inhibitor B *9 | 0.05 g/m$^2$ |
| Discoloration inhibitor C *8 | 0.02 g/m$^2$ |
| Coupler solvent *18 | 0.60 g/m$^2$ |
| 7th Layer (Yellow Filter Layer): | |
| Yellow colloidal silver | 0.20 g-Ag/m$^2$ |
| Gelatin | 1.00 g/m$^2$ |
| Color mixing preventing agent *14 | 0.06 g/m$^2$ |
| Solvent for color mixing preventing agent *13 | 0.24 g/m$^2$ |
| 8th Layer (Low-Sensitive Blue-Sensitive Layer): | |
| Silver iodobromide emulsion spectrally sensitized with blue sensitizing dye *16 (silver iodide: 2.5 mol %; mean grain size: 0.5 μm) | 0.15 g-Ag/m$^2$ |
| Gelatin | 0.50 g/m$^2$ |
| Yellow coupler *15 | 0.20 g/m$^2$ |
| Coupler solvent *18 | 0.05 g/m$^2$ |
| 9th Layer (High-Sensitive Blue-Sensitive Layer): | |
| Silver iodobromide emulsion spectrally sensitized with blue sensitizing dye *16 (silver iodide: 2.5 mol %; mean grain size: 1.4 μm) | 0.20 g-Ag/m$^2$ |
| 10th Layer (Ultraviolet Absorbing Layer): | |
| Gelatin | 1.50 g/m$^2$ |
| Ultraviolet absorbent *19 | 1.0 g/m$^2$ |
| Ultraviolet absorbent solvent *18 | 0.30 g/m$^2$ |
| Color mixing preventing agent *17 | 0.08 g/m$^2$ |
| 11th Layer (Protective Layer): | |
| Gelatin | 1.0 g/m$^2$ |

The compounds used in the above sample preparation are as follows:

*1: Dioctyl phthalate

*2: 2-(2-Hyroxy-3-sec-butyl-5-t-butylphenyl)benzotriazole

*3: 2-[α-(2,4-di-t-amylphenoxy)butaneamido]-4,6-dichloro-5-ethylphenol

*4: 5,5'-Dichloro-3,3'-di(3-sulfobutyl)-9-ethylthiacarbocyanine sodium salt

*5: Triethylammonium-3-[2-{2-[3-(3-sulfopropyl)naphtho-(1,2-d)thiazolin-2-ylidinemethyl]-1-butenyl}]-3-naphtho(1,2-d)thiazolino propanesulfonate

*6: Polyethyl acrylate

*7: Trioctyl phosphate

*8: 2,4-Di-t-hexylhydroquinone

*9: Di-(2-hydroxy-3-t-butyl-5-methylphenyl)methane

*10: 3,3,3',3'-Tetramethyl-5,6,5',6'-tetrapropoxy-1,1'-bisspiroindane

*11: Magenta Coupler M-5

*12: 5,5'-Diphenyl-9-ethyl-3,3'-disulfopropyloxacarbocyanine sodium salt

*13: o-Cresyl phosphate

*14: 2,4-Di-t-octylhydroquinone

*15: α-Pivaloyl-α-[2,4-dioxo-1-benzyl-5-ethoxyhydantoin-3-yl)-2-chloro-5-(α-2,4-dioxo-5-amylphenoxy)-butaneamino]acetanilide

*16: Triethylammonium 3-[2-(3-benzylrhodanin-5-yl-idene)-3-benzoxazolinyl]propanesulfonate

*17: 2,4-Di-sec-octylhydroquinone

*18: Trinonyl phosphate

*19: 5-Chloro-2-(2-hydroxy-3-t-butyl-5-t-octyl)phenylbenzotriazole

The thus prepared sample was designated as Sample K.

Samples L to T were prepared in the same manner as for Sample K, except that the 5th and 6th layers further contained in the lipophilic fine particles containing the coupler each of the compounds shown in Table 4 in an amount of 30 mol% based on the coupler in the cases of Samples M and O and T, or in an amount of 30 mg/m$^2$ in the case of Sample N.

TABLE 4

| Sample No. | Compound Added |
|---|---|
| L | Di-t-octylhydroquinone |
| M | Sodium p-toluenesulfinate |
| N | Sulfinic acid homopolymer having a repeating unit of formula: 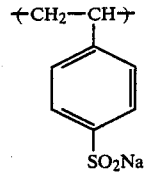 |
| O | I-9 |
| P | I-11 |
| Q | I-32 |
| R | I-33 |
| S | I-34 |
| T | I-73 |

Each of the resulting samples K to T was exposed to light through an optical wedge and subjected to development processing according to the following instructions.

| Development Step | Temperature | Time |
|---|---|---|
| First Development (black-and-white development) | 38° C. | 1'15" |
| Washing | 38° C. | 1'30" |
| Reversal Exposure | above 100 lux | 1' |
| Color Development | 38° C. | 2'15" |
| Washing | 38° C. | 45" |
| Bleach-Fixing | 38° C. | 2'00" |
| Washing | 38° C. | 2'15" |

First Developing Solution Formulation:

| | |
|---|---|
| Pentasodium nitrilo-N,N,N—trimethylenephosphonate | 0.6 g |
| Pentasodium diethylenetriamine-pentaacetate | 4.0 g |
| Potassium sulfite | 30.0 g |
| Potassium thiocyanate | 1.2 g |
| Potassium carbonate | 35.0 g |
| Potassium hydroquinone monosulfonate | 25.0 g |
| Diethylene glycol | 15.0 ml |
| 1-Phenyl-4-hydroxymethyl-4-methyl-3-pyrazolidone | 2.0 g |
| Potassium bromide | 0.5 g |
| Potassium iodide | 5.0 mg |
| Water to make | 1000 ml (pH = 9.70) |

-continued

Color Developing Solution Formulation:

| | |
|---|---|
| Benzyl alcohol | 15.0 ml |
| Diethylene glycol | 12.0 ml |
| 3,6-Dithia-1,8-octanediol | 0.2 g |
| Pentasodium nitrolo-N,N,N—trimethylenephosphonate | 0.5 g |
| Pentasodium diethylenetriamine-pentaacetate | 2.0 g |
| Sodium sulfite | 2.0 g |
| Potassium carbonate | 25.0 g |
| Hydroxylamine sulfate | 3.0 g |
| N—Ethyl-N—(β-methanesulfonamidoethyl)-3-methyl-4-aminoaniline sulfate | 5.0 g |
| Potassium bromide | 0.5 g |
| Potassium iodide | 1.0 mg |
| Water to make | 1000 ml (pH = 10.40) |

Bleach-Fixing Solution Formulation:

| | |
|---|---|
| 2-Mercapto-1,3,4-triazole | 1.0 g |
| Disodium ethylenediaminetetraacetate dihydrate | 5.0 g |
| Ammonium (ethylenediaminetetraacetate) Fe (III) monohydrate | 80.0 g |
| Sodium sulfite | 15.0 g |
| Sodium thiosulfate (700 g/l) | 160.0 ml |
| Glacial acetic acid | 5.0 ml |
| Water to make | 1000 ml (pH = 6.50) |

Each of the thus processed samples was evaluated for stain formation in the same manner as in Example 1, and the results obtained are shown in Table 5 below.

TABLE 5

| Sample No. | Compound Added | Increase in Stain Density: 40° C., 70% RH 2 Weeks | Increase in Stain Density: Room Temp. 35 Days | Remark |
|---|---|---|---|---|
| K | — | 0.08 | 0.06 | Control |
| J | di-t-octylhydroquinone | 0.06 | 0.05 | Comparison |
| M | sodium p-toluenesulfinate | 0.07 | 0.05 | " |
| N | sulfinic polymer | 0.06 | 0.05 | " |
| O | I-9 | 0.02 | 0.01 | Invention |
| P | I-11 | 0.02 | 0.01 | " |
| Q | I-32 | 0.01 | 0.02 | " |
| R | I-33 | 0.02 | 0.01 | " |
| S | I-34 | 0.02 | 0.02 | " |
| T | I-73 | 0.02 | 0.01 | " |

As can be seen from Table 5, the water-soluble lipophilic compounds according to the present invention exert marked effects on the prevention of stain formation due to aging after processing as compared with conventionally known reducing agents, such as hydroquinones, etc., water-soluble sulfinic acid salts or sulfinic acid polymers.

The similar effects as observed in Table 5 were obtained when the compound of formula (I) according to the present invention was incorporated into either one of the 5th layer and the 6th layer.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having provided thereon at least one silver halide emulsion layer having dispersed therein lipophilic fine particles containing an image dye forming lipophilic coupler and at least one lipophilic compound having a water-solubility of not more than 1% by weight at 25° C. and represented by formula (I):

$$R_O SO_2X \quad (I)$$

wherein $R_O$ represents a substituted or unsubstituted alkyl, aryl or heterocyclic group having 8 or more total carbon atoms; and X represents a hydrogen atom, an alkali metal atom, an alkaline earth metal atom, a nitrogen-containing organic base, ammonium, or a group represented by formula (A):

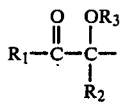

(A)

wherein $R_1$ represents a hydrogen atom or a substituted or unsubstituted alkyl, aryl or heterocyclic group; $R_2$ represents a hydrogen atom, a halogen atom or a substituted or unsubstituted alkyl, aryl, acyloxy or sulfonyl group; and $R_3$ represents a hydrogen atom or a hydrolyzable group.

2. The silver halide color photographic material as in claim 1, wherein said compound represented by formula (I) is present in an amount of from $1\times10^{-2}$ to 10 mol per mol of the coupler.

3. The silver halide color photographic material as in claim 1, wherein said coupler is a magenta coupler.

4. The silver halide color photographic material as in claim 3, wherein said magenta coupler is represented by formula (VIII):

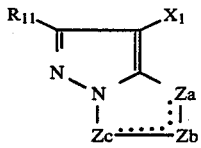

(VIII)

wherein $R_{11}$ represents a hydrogen atom or a substituent; $X_1$ represents a hydrogen atom or a group releasable upon coupling with an oxidation product of an aromatic primary amine developing agent; Za, Zb and Zc each represents a methine group, a substituted methine group, =N— or —NH—, wherein either the Za-Zb bond or the Zb-Zc bond is a double bond, with the other being a single bond; the Zb-Zc bond when representing a carbon-carbon double bond may form a part of an aromatic ring; $R_{11}$, $X_1$ or the substituted methine group as represented by Za, Zb or Zc may form a polymer including a dimer.

5. The silver halide color photographic material as in claim 1, wherein the molecular weight of the compound of formula (I) is less than 1,000.

6. The silver halide color photographic material as in claim 1, wherein said lipophilic compound is represented by formula (I)-B:

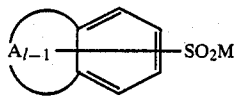

(I)-B wherein A represents an atomic group forming an aromatic ring, inclusive of a heterocyclic ring, condensed to the benzene ring, wherein said aromatic ring or benzene ring is substituted or unsubstituted; M represents a hydrogen atom, an ammonium ion, an alkali metal ion, or alkaline earth metal ion; l represents 1 or 1; and $SO_2M$ is single or plural.

7. The silver halide color photographic material as in claim 1, wherein $R_3$ is a hydrolyzable group having the formula

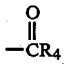

wherein $R_4$ represents a hydrogen atom, a substituted or unsubstituted straight or branched chain alkyl group having 1 to 20 carbon atoms, a substituted or unsubstituted aryl group having 6 to 30 carbon atoms, an acyl group having from 2 to 20 carbon atoms, or an alkoxy group having 1 to 20 carbon atoms.

8. The silver halide color photographic material as in claim 1, wherein the lipophilic fine particles have an oil-coupler ratio from 0.00 to 2.0 by weight.

9. The silver halide color photographic material as in claim 4, wherein $R_{11}$ represents a hydrogen atom, a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamide group, a carbamoyl group, an acyl group, a sulfamoyl group, a sulfonyl group, a sulfinyl group, an alkoxycarbonyl group, or an aryloxycarbonyl group.

10. The silver halide color photographic material as in claim 4, comprising $1\times10^{-3}$ to 1 mol of magenta coupler per mole of silver halide.

11. The silver halide color photographic material as in claim 1, wherein said coupler is a cyan coupler.

12. The silver halide color photographic material as in claim 1, wherein said coupler is a yellow coupler.

* * * * *